US005867755A

United States Patent [19]

Sato

[11] Patent Number: 5,867,755

[45] Date of Patent: Feb. 2, 1999

[54] ELECTROPHOTOGRAPHIC TYPE IMAGE FORMING DEVICE AND DEVELOPING ROLLER FOR USE IN THE DEVICE

[75] Inventor: Shougo Sato, Seto, Japan

[73] Assignee: Brother Kogyo Kabushiki Kaisha, Nagoya, Japan

[21] Appl. No.: 759,225

[22] Filed: Dec. 5, 1996

[30] Foreign Application Priority Data

| | | | |
|---|---|---|---|
| Dec. 5, 1995 | [JP] | Japan | 7-316991 |
| Dec. 7, 1995 | [JP] | Japan | 7-319420 |
| Dec. 8, 1995 | [JP] | Japan | 7-320916 |
| Dec. 28, 1995 | [JP] | Japan | 7-343161 |
| Feb. 9, 1996 | [JP] | Japan | 8-024500 |

[51] Int. Cl.[6] ..... G03G 15/08; G03G 15/30

[52] U.S. Cl. ..... 399/149; 399/279; 399/286; 492/28

[58] Field of Search ..... 399/149, 279, 399/286; 492/28, 56, 59

[56] References Cited

U.S. PATENT DOCUMENTS

| | | | |
|---|---|---|---|
| 4,317,265 | 3/1982 | Chase et al. | 492/56 |
| 4,800,147 | 1/1989 | Savage | 399/71 X |
| 5,232,500 | 8/1993 | Kamaji et al. | 399/284 X |
| 5,253,023 | 10/1993 | Hosaka et al. | 399/149 |
| 5,283,618 | 2/1994 | Hosoya et al. | 399/150 |
| 5,434,653 | 7/1995 | Takizawa et al. | 399/284 |
| 5,600,417 | 2/1997 | Iguchi et al. | 399/279 |
| 5,697,027 | 12/1997 | Takagi et al. | 399/279 |

FOREIGN PATENT DOCUMENTS

| | | |
|---|---|---|
| 0-400-571-A2 | 12/1990 | European Pat. Off. . |
| 0-411-579-A2 | 2/1991 | European Pat. Off. . |
| 0-520-799-A2 | 12/1992 | European Pat. Off. . |
| 0-540-341-A2 | 5/1993 | European Pat. Off. . |
| 0-575-159-A2 | 12/1993 | European Pat. Off. . |
| 0-657-896-A1 | 6/1995 | European Pat. Off. . |
| 0-684-613-A2 | 11/1995 | European Pat. Off. . |
| 42-04-470-A1 | 8/1992 | Germany . |
| 5-188774 | 7/1993 | Japan . |
| 7-77859 | 3/1995 | Japan . |
| 7-261542 | 10/1995 | Japan . |
| 8-272211 | 10/1996 | Japan . |

*Primary Examiner*—William Royer
*Attorney, Agent, or Firm*—Oliff & Berridge, PLC

[57] ABSTRACT

An electrophotographic type image forming device having a developing roller and a photosensitive drum. A nip portion is provided therebetween for supplying developing agents from the developing roller to the photosensitive drum. The developing roller and the photosensitive drum are rotated in the same rotational direction, i.e, a peripheral moving direction of the developing roller is opposite to peripheral moving direction of the photosensitive drum at the nip portion, so that toners provide vivid mobility at or adjacent the nip portion so as to cancel Van der Waals attraction force, and so that the toners can be attracted to the photosensitive drum only by applied electrical field. Developing is performed immediately upstream of the nip portion in rotational direction of the developing roller, and residual toners are collected by the developing roller immediately downstream of the nip portion for collecting and reusing the residual toners. Spherical tones as well as pulverized toners are used as the developing agent.

23 Claims, 11 Drawing Sheets

ELECTROPHOTOGRAPHIC TYPE IMAGE FORMING DEVICE AND DEVELOPING ROLLER FOR USE IN THE DEVICE

BACKGROUND OF THE INVENTION

The present invention relates to an electrophotographic type image forming device such as a laser printer, a facsimile machine, and a copying machine, and more particularly, to the image forming device of so called cleanerless type in which residual toners after transfer operation is re-used in a subsequent developing operation instead of accumulation of the residual toners in a form of waste toners. The present invention also relates to a developing roller for use in the image forming device.

In an image forming device such as a laser printer and a copying machine, residual toners remaining on a photosensitive member after the transfer operation are scraped off by a resilient blade, and are stored in a waste toner case, and the case must be periodically scrapped.

However, in such a conventional image forming device, operator's hand or clothes are contaminated at the time of scrapping the toners, and toners may be dispersed during transportation of the waste toner case due to destruction of the toner case. Therefore, working environment may be polluted, and such defect does not meet with the ecological standpoint.

Therefore, so called cleaner-less system has been proposed in which residual toners remaining on the photosensitive member are collected by the developing means and is reused in a subsequent developing operation.

One example of a cleaner-less type image forming device will be described with reference to FIG. 16.

A laser printer 200 shown in FIG. 16 generally includes a main case 202, a sheet cassette 214 provided at a bottom of the main case 202, a sheet supply roller 213 for supplying each one of a sheet P stored in the sheet cassette 214, a photosensitive drum 220 provided above the sheet supply roller 213, a transfer roller 260 in pressure contact with the photosensitive drum 220 and is positioned therebelow, a fixing unit 270 disposed in the vicinity of the photosensitive drum 220, and a sheet discharge tray 277 disposed above the photosensitive drum 220. That is, a meandered or zigzag sheet transport pathway PP is provided starting from the sheet cassette 214 as shown by a dotted chain line so as to provide a compact laser printer 200.

After the electrical charge on the photosensitive drum 220 is removed by a discharge lamp 241, a laser beam L emitted from a laser scanner unit 230 is irradiated on the photosensitive drum 220 to form an electrostatic latent image in a state where a charger 240 uniformly charges the surface of the photosensitive drum 220 with a predetermined polarity. This electrostatic latent image is developed into a visible image by charged toners supplied from a developing roller 256 which is integrally disposed in a toner cartridge 250 and in contact with the photosensitive drum 220, thereby forming a toner image. This toner image is then transferred by the transfer roller 260 onto a fed sheet P. The toner image on the sheet P is fixed to the sheet P by a heat roller 271 of the fixing unit 270. Finally, the sheet P carrying thereon the output image is discharged onto the discharge tray 277.

On the other hand, residual toners remaining on the photosensitive drum 220 after the image transfer operation are temporarily stored on a cleaning roller 280 by applying to the cleaning roller 280 a voltage whose polarity is opposite the polarity of the toners. After completion of the transferring operation onto the sheet P, voltage having the polarity the same as that of the toners is then applied to the cleaning roller 280, so that the residual toners on the cleaning roller 280 are again discharged onto the photosensitive drum 220, and are collected into the toner cartridge 250 by the developing roller 256.

Here, in the toner cartridge 250, the developing roller 256 and a toner supply roller 255 in pressure contact with the developing roller for supplying toners 253 to the developing roller 256 are both rotatably disposed. Further, in the toner cartridge 250, a thickness regulation blade 257 is provided for regulating a thickness of the toner layer adhered onto the developing roller 256 into a predetermined thickness and for charging the toners 253. The developing roller 256 and the photosensitive drum 220 are driven to be rotated in directions shown by arrows so that surplus toners 253 removed by the thickness regulation blade 257 can be dropped onto the toner supply roller 255.

That is, the developing roller 156 is driven to be rotated in a direction opposite the rotating direction of the photosensitive drum 220 in pressure contact therewith, because the developing operation is performed while charging the toners 253 with the predetermined polarity by the developing roller. In other words, at a nip portion between the developing roller 256 and the photosensitive drum 220, these are driven to be moved in the same direction with each other.

Further, in the laser printer 200 shown in FIG. 9, the toners 253 are polymerized toners which provide high fluidity. If pulverized toners are used instead of the polymerized toners, amount of residual toners remaining on the photosensitive drum 220 may be increased after transfer operation due to low fluidity. Further, efficiency for collecting the residual toners by the cleaning roller 280 and the developing roller 256 may be lowered. As a result, residual toners can not be sufficiency collected, and may reach the transferring region, and are transferred onto the sheet P by the transfer roller 260. Consequently, a ghost image corresponding to the distribution of the residual toners on the photosensitive drum 220 may be generated in the sheet P.

Generally, polymerized toners and pulverized toners respectively provide advantage and disadvantage, and determination cannot be unqualifiedly made as to which one is superior to the other. The pulverized toners are provided by mulling wax, CCA(charge control agent), and coloring agent (carbon black if black color is to be generated) with a resin such as styrene acrylic resin and polyester resin, and then by pulverizing the mulled mixture. Due to the pulverization, toners may have irregular shape and have many corners. As a result, the toners do not provide sufficient fluidity. Accordingly, the toners do not provide sufficient spreading characteristic in the developing unit, to lower transferring efficiency. On the other hand, because of the low fluidity, toner leaking amount through a minute gap can be reduced, which facilitates a design of a sealing member which is adapted for avoiding toner leakage.

Constituents of the polymerized toners are not greatly different from those of the pulverized toners. However, method for producing the polymerized toners is quite different from the method for producing the pulverized toners. For producing the polymerized toners, raw materials are dispersed in a solvent, so that the polymerized toner has generally spherical shape because of the surface tension. According to the recent technique, it is impossible to produce toners by polymerization method using polyester resin. Therefore, styrene acrylic resin is widely used. The polymerized toner has generally spherical shape, so that it can provide high fluidity. As a result, the toners are sufficiently spread in the developing unit to provide high transferring efficiency. However, due to the high fluidity, toners may be easily leaked through a fine gap, and therefore careful attention is required in designing a sealing member.

Further, in the laser printer 200, as shown by the dotted chain line in FIG. 9, the sheet transport pathway PP is meandered, and therefore, a special sheet such as a thick sheet or an envelope are not available which are disadvantageous for image transfer. If a linear sheet passage can be provided, printing can be made on the thick sheet and the envelope. However, in this case, amount of residual toners remaining on the photosensitive drum 220 may be increased due to insufficient transfer of the toners. Accordingly, the residual toners cannot be completely collected by the cleaning roller 280 and the developing roller 256, so that ghost may be generated on the sheet P, similar to the above described disadvantages.

That is, as described above, it is difficult in the cleaner-less type image forming device to use the pulverized tones which are easily produced but provides low fluidity. Therefore, the device must use the polymerized toners which provide high transferring efficiency but are difficult to produce. Consequently, design of a sealing member may become difficult, the sealing member being adapted for preventing the toners from leakage at a position around the developing roller 256.

Further, in using the polymerized toners, amount of residual toners remaining on the photosensitive drum may be increased particularly in a low temperature, low humidity condition when image is formed on the special sheet such as the thick sheet and the envelope those providing low transferring efficiency. Therefore, the residual toners cannot be completely collected by the developing roller, and ghost may be generated.

The cleaner-less type still requires means for temporarily storing residual toners during printing such as the above described cleaning roller 280. Therefore, additional power source is required in comparison with a system where cleaning blade is provided for scraping off the residual toners.

Further, instead of the cleaning roller, toner leveling brush can be used for leveling the residual toners on the photosensitive drum. In this case, additional power source is unnecessary. However, the toner leveling brush cannot completely collect the residual toners if the amount of the residual toners is increased, and therefore, ghost may be generated.

Further, in another conventional electrophotographic type image forming device, transferring means such as a transfer roller is disposed above the photosensitive drum. This structure is advantageous in that accessing to a sheet passage becomes possible by opening the device from upper side so as to deal with the sheet jamming. This is advantageous over a structure shown in FIG. 16 in which the transfer roller 260 is disposed below the photosensitive drum 220. Further, if the transfer roller is disposed above the photosensitive drum, a sheet cassette can be exposed to the upper side, which facilitates supply of the sheet, and furthermore, a linear sheet passage can be provided, which is capable of printing to a special sheets such as a thick sheet, an envelope and OHP sheet. With such reasons, in the conventional image forming device, the transfer roller is desired to be disposed above the photosensitive drum.

On the other hand, according to the developing process in this type of image forming device, an elastic roller formed of an electrically conductive silicone is used as the developing roller which carries toners, and so called impression developing process is performed in which the developing roller is depressed against the photosensitive drum for developing operation. According to this process, efficient developing operation can be performed by enhancing the developing efficiency of the toners. However, the toners also serve as lubricants. By the existence of the toners at the nip portion where the developing roller and the photosensitive drum are in contact with each other, developing operation can be performed with maintaining a smooth contact between the developing roller and the photosensitive drum.

However, as described above, in the impression developing method in which the transfer roller is disposed above the photosensitive drum, rotating direction of the developing roller is opposite to the rotating direction of the photosensitive drum with respect to the nip portion taking the sheet feeding direction(rotating direction of the photosensitive drum) and toner supplying direction toward the photosensitive drum into consideration. Therefore, if developing operation is performed with the developing efficiency close to 100% in case of the solid black printing, almost all the toners are used for the developing the electrostatic latent image on the photosensitive drum at a position above the nip portion. Accordingly at the nip portion, extremely small volume of toner or no toner is provided. As a result, smooth contact between the developing roller and the photosensitive drum at the nip portion cannot be maintained due to non-existence of the lubricant, i.e., the toners. As a result, a surface of the developing roller may be irregularly deformed or vibrated to cause chattering due to the friction between the developing roller and the photosensitive drum. Finally, corrugated pattern may be generated in an output image due to the chattering. On the other hand, by lowering the developing efficiency, it is possible to retain the toners at the nip portion on the developing roller even in case of the solid black printing. However, this leads to degradation of the output image.

Further, in the impression developing method in which the transfer roller is disposed above the photosensitive drum and rotating direction of the developing roller is opposite to the rotating direction of the photosensitive drum with respect to the nip portion, the developing roller formed of silicone may easily be worn, so that striped scratches may be generated on the developing roller, which leads to insufficient printing where striped pattern is formed in an output image. Further, service life of the developing roller, which is expendables, may be shortened.

Further, in the electrophotographic type image forming device, in order to enhance imaging quality, fluidity is required in the toners so that the toners can be properly subjected to developing, transferring and cleaning on the photosensitive drum. To this effect, the surface of the toner is added with additives such as silica.

If the toners having high fluidity are used capable of performing high imaging quality (for example, 600 dpi), the toners scraped from the developing roller by the photosensitive drum is deposited on the upper portion of the nip portion due to the rotational directions of the photosensitive drum and the developing roller. As a result, the deposited tones may adhere to an unwanted portion due to the Van der Waals attraction on the photosensitive drum, which portion does not correspond to the electrostatic latent image portion. As a result, foggy portion may be generated on the transferred image in the sheet, to lower the quality of the image.

In another aspect, the developing roller is imparted with an electrical conductivity by an electron conduction capable of being applied with the developing bias voltage. That is, electrical conductivity is imparted on the developing roller by dispersing electrically conductive minute particles such as carbon particles into the elastic material which is the base material of the developing roller.

In this developing method, efficient developing can be performed by enhancing developing efficiency of the toners. On the other hand, the toners also serve as electrically insulating materials located between the photosensitive drum and the developing roller to which the developing bias is applied. Because of the existence of the toners at the nip portion between the developing roller and the photosensitive drum, surface voltage level of the photosensitive drum can be stably maintained in developing operation.

However, as described above, if 100% developing efficiency is contemplated in the developing operation, almost all the toners are adhered to the photosensitive drum at a position above the nip portion in case of solid black printing. Accordingly at the nip portion, extremely small volume of toner or no toner is provided serving also as the electrical insulator. As a result, electrical insulation cannot be maintained between the developing roller and the photosensitive drum at the nip portion due to non-existence of the toner, and consequently, the developing bias voltage applied to the developing roller may be leaked to the photosensitive drum. Accordingly, the surface voltage of the photosensitive drum becomes unstable, to lower imaging quality.

On the other hand, it is possible to still retain toners at the nip portion on the developing roller even in the case of solid black printing by lowering the developing efficiency. However, this causes degradation of the output image.

SUMMARY OF THE INVENTION

The present invention is established to solve the above described problems, and it is therefore an object of the present invention is to provide a cleaner-less type image forming device capable of providing high quality image and capable of collecting residual toners by a developing roller without using a toner scraping blade in a condition where the developing roller and a photosensitive roller are rotated in the same rotational direction while using pulverized toners as well as spherical toners.

Another object of the present invention is to provide such image forming device capable of producing high quality image without generation of ghost even in the operational condition where amount of the residual toners is increased, such as employment of pulverized toners, image formation on a thick sheet or envelope, and image formation under the low temperature low humidity condition or high temperature high humidity condition.

Another object of the present invention is to provide the image forming device capable of providing a toner layer having a predetermined thickness on the developing roller.

Still another object of the present invention is to provide such image forming device capable of avoiding generation of a corrugated image in the output image by restraining chattering or vibration at the nip portion between the developing roller and the photosensitive drum in spite of printing at high developing efficiency.

Still another object of the present invention is to provide such image forming device capable of avoiding generation of a striped image due to scratch or frictional wearing of the developing roller and capable of having prolonged service life.

Still another object of the present invention is to provide such image forming device capable of avoiding leakage of the biasing voltage from the developing roller to the photosensitive drum in spite of the image forming operation at high developing efficiency.

These and other objects of the present invention will be attained by providing an image forming device for forming an image on an image receiving medium, the device including a latent image holding member having a latent image holding surface, means for forming a latent image on the latent image holding surface, developing means, transfer means, first drive means and second drive means. The developing means has a toner carrying member on which a toner layer is formed. The developing means provides a contact of the toner layer with the latent image holding surface forming thereon the latent image at a developing portion so as to convert the latent image into a toner image. The latent image holding member and the toner carrying member provide a nip portion at the most nearest position therebetween. The transfer means is adapted for transferring the toner image onto the image receiving medium while the image receiving medium is moved in a direction. The toner carrying member also collects, at a residual toner collecting portion, residual toners remaining on the latent image holding member after the transfer of the toner image onto the image receiving medium. The first drive means is adapted for driving the latent image holding member in a predetermined direction in synchronism with the movement of the image receiving medium. The second drive means is adapted for driving the toner carrying member in a direction opposite a moving direction of the latent image holding member at the nip portion.

In another aspect of the invention, there is provided a developing roller for use in an image forming device, the developing roller including an inner portion; and a surface portion provided over the inner portion and on which a toner layer is formed, at least the surface portion having a hardness not less than Asker-C 65 degrees. Alternatively, at least the surface portion is formed of a polyurethane elastomer. Further alternatively, at least the peripheral surface portion is formed of an ionic conductive material.

DETAILED DESCRIPTION OF THE PREFERRED EMBODIMENTS

An electrophotographic type image forming device according to a first embodiment of the present invention will be described with reference to FIGS. 1 through 10. The illustrated embodiment is applied to a laser printer having a feeder unit, a photosensitive drum and a laser scanner unit.

Figure 1:
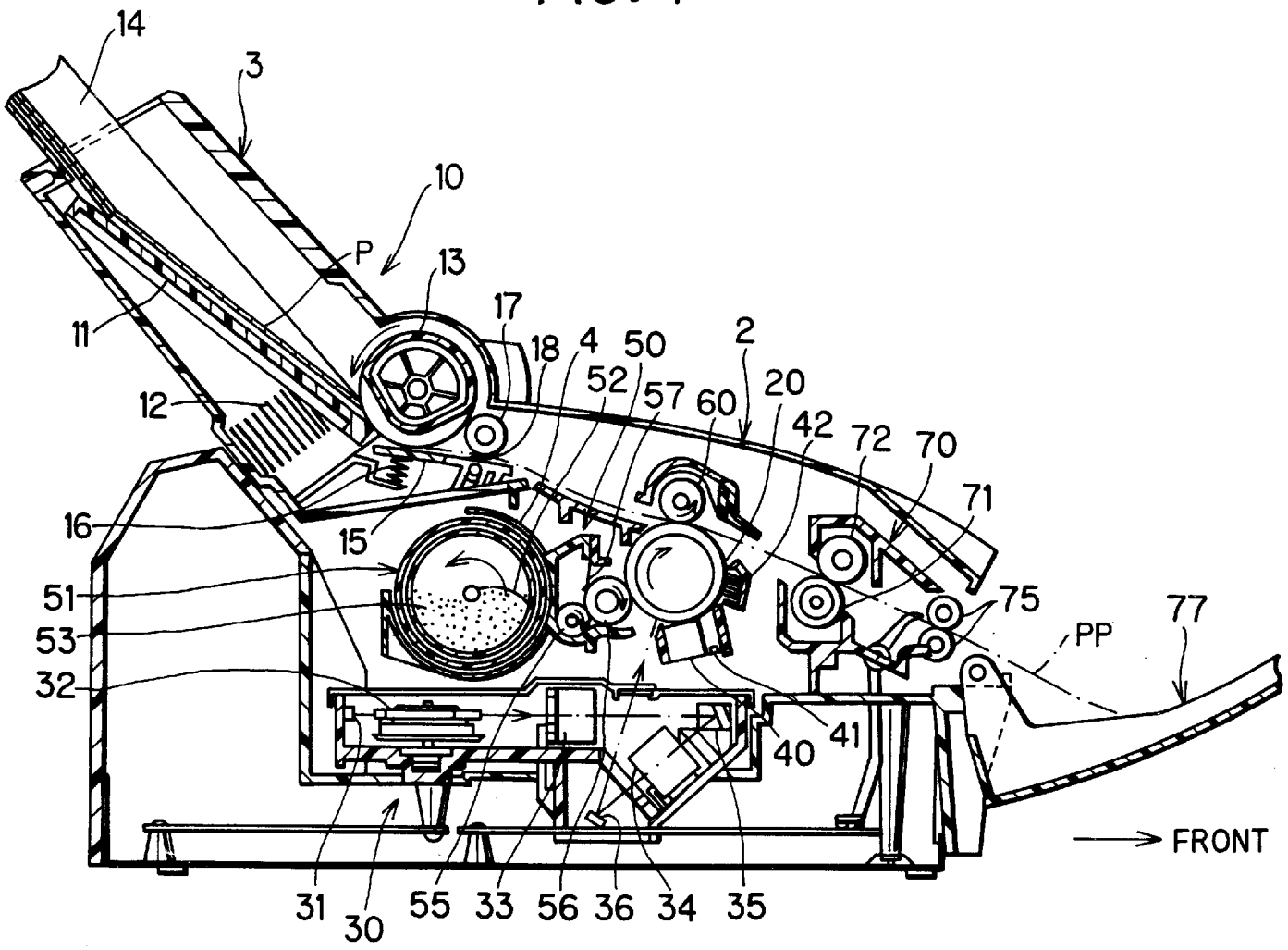
FIG. 1 is a cross-sectional side view showing a laser printer according to a first embodiment of the present invention.

As shown in FIG. 1, a laser printer 1 includes a case 2, a feed unit 10 for supplying sheets P (image receiving member) on which images are to be formed, a photosensitive drum 20 (latent image holding member) to which a laser beam L is irradiated, charging means 40 for charging the surface of the photosensitive drum 20 with a predetermined polarity, a laser scanner unit 30 for forming an electrostatic latent image on the charged photosensitive drum 20 (a combination of the charging means and the laser scanner unit constitutes latent image forming means), a developing unit 50 including a developing roller 56(toner carrying member), a transfer roller 60 (image transfer means) for transferring a toner image on the photosensitive drum 20 onto a sheet P, a fixing unit 70, a discharge tray 77 onto which sheets with the fixed images formed thereon are discharged, a first drive mechanism 80 for driving the photosensitive drum 20, and a second drive mechanism 100 for driving the developing roller 56.

The feed unit 10 will first be described. As shown in FIG. 1, the feed unit 10 includes a feeder case 3 disposed at the upper rear end of a case 3. A sheet-pressing plate 11 having a width substantially the same as the width of sheets P is supported within the feeder case 3. The sheet pressing plate 11 has a rearmost edge pivotally supported to the feeder case 3. A compression spring 12 is disposed at the frontmost edge of the sheet pressing plate 11 for resiliently urging the pressing plate 11 upwardly. A sheet-supply roller 13 extending in a widthwise direction of the sheet P is rotatably supported to the sheet pressing plate 11. A sheet-cassette 14 capable of housing a plurality of stacked sheets cut into a predetermined shape is detachably and slantingly mounted in the case 3. Rotation of the sheet-supply roller 13 supplies an uppermost sheet P of the sheet stack contained in the sheet-supply cassette 14. A drive system (not shown in the drawings) is connected to the sheet feed roller 13 for driving the sheetroller 13 to rotate at a proper sheet supplying timing.

A separation member 15 for preventing two sheets from being supplied at the same time is provided below the sheet-supply roller 13. A compression spring 16 is provided for resiliently urging the separating member 15 against the sheet-supply roller 13. A pair of resist rollers 17, 18 for aligning the leading edge of supplied sheet P is rotatably provided downstream of the sheet supply roller 13 in a sheet-transport direction.

Figure 2:
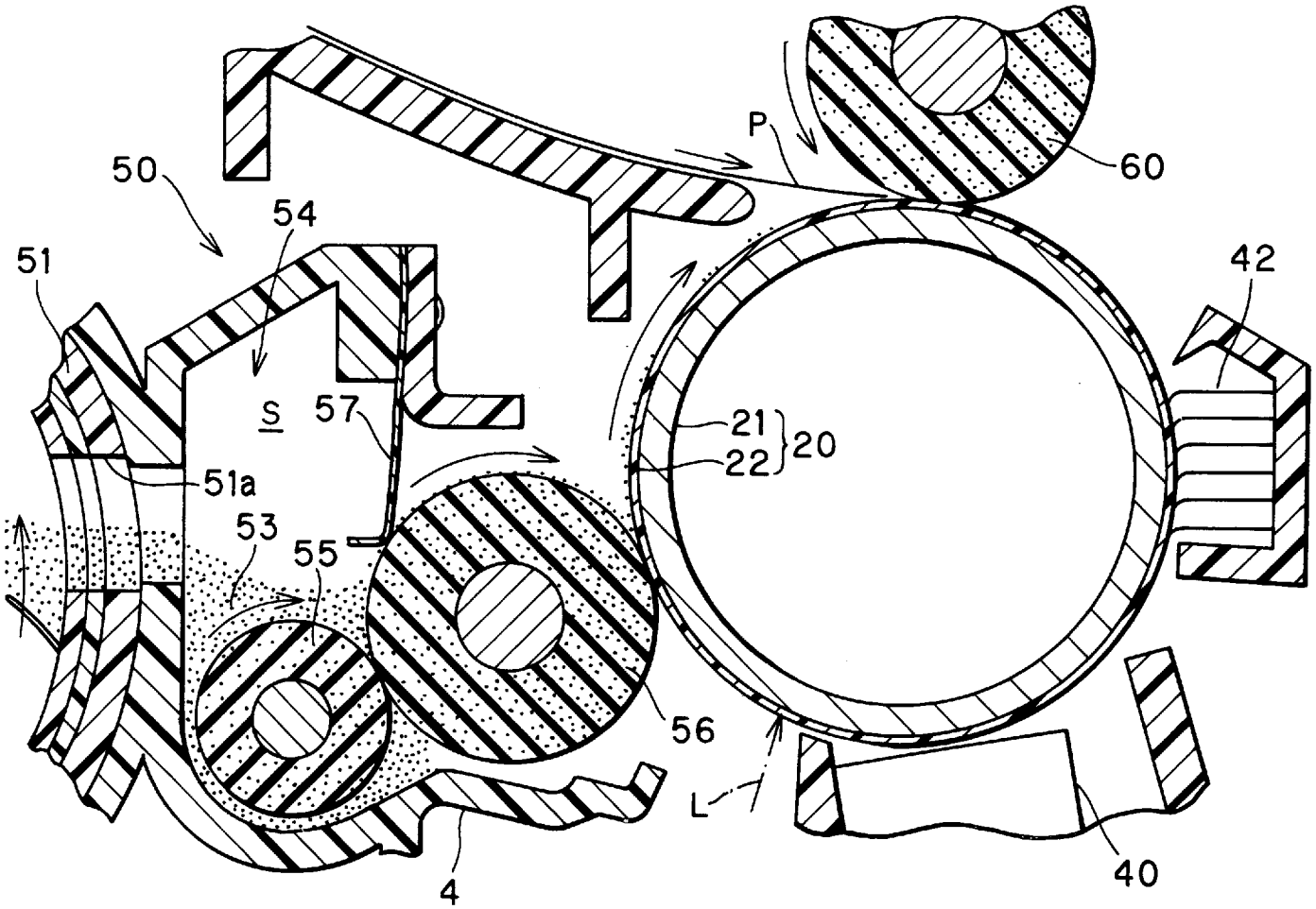
FIG. 2 is an enlarged side view showing details of a developing unit according to the first embodiment.
Figure 5:
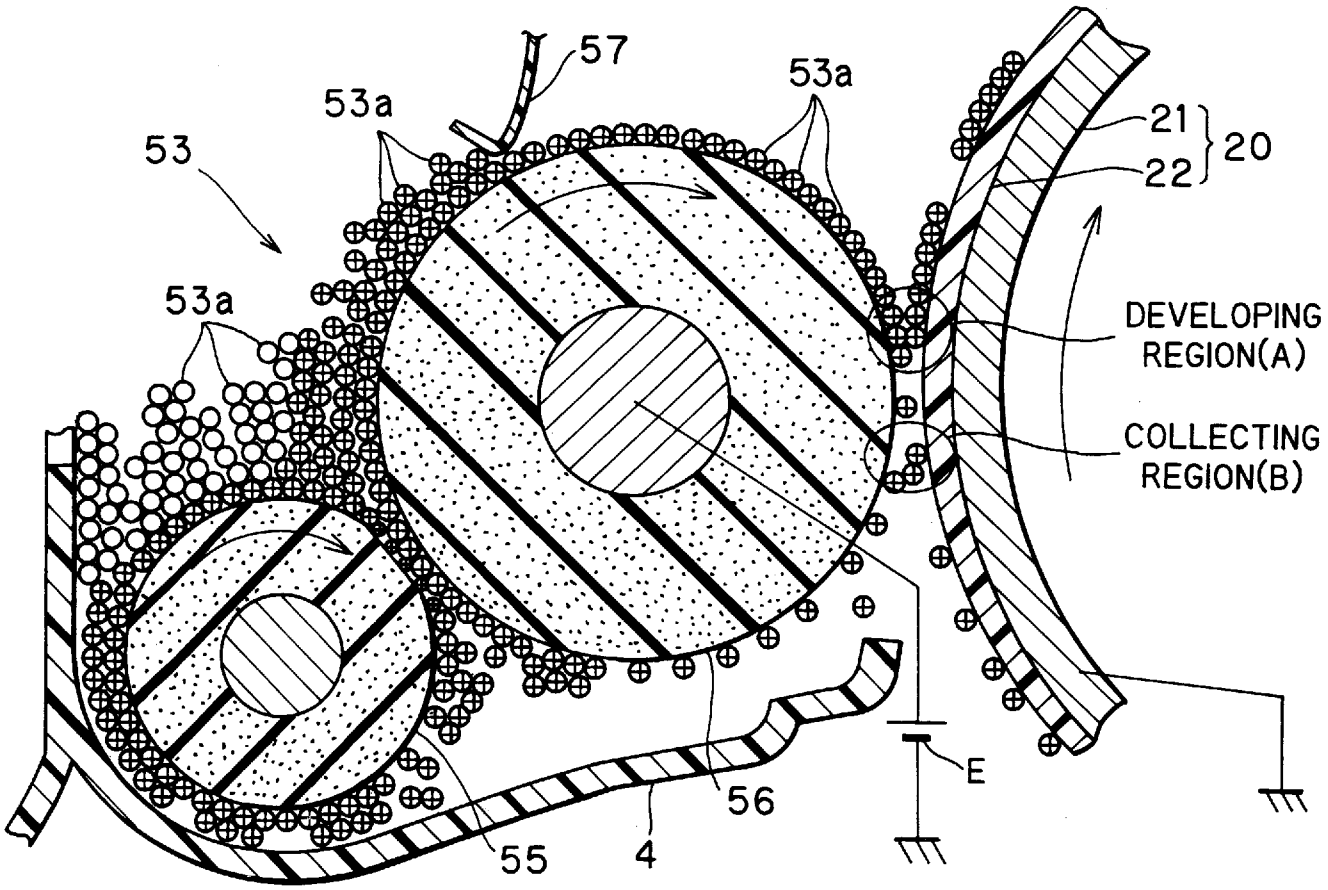
FIG. 5 is an enlarged side view showing an essential portion of FIG. 2.

As shown in FIGS. 1, 2, and 5, the photosensitive drum 20 is formed of a material having a positively chargeable characteristic. The photosensitive drum 20 includes a hollow cylindrical aluminum sleeve 21 and a photoconductive layer 22 formed to a predetermined thickness, (for example, about 20 $\mu$m) to the outer peripheral surface of the sleeve 21. The photo-conductive layer 22 is made of a poly-carbonate and a photo-conductive resin. The sleeve 21 is rotatably mounted on the case 2 in a grounded condition. With this configuration, developing is possible by reversal development wherein positively charged toner 53 develops a positively charged electrostatic latent image formed on the surface of the photosensitive drum 20.

The laser scanner unit 30 is disposed below the photosensitive drum 20 and includes a laser emitting unit 31 for generating the laser light L to form electrostatic latent image on the surface of the photosensitive drum 20, a five-sided polygon mirror 32 driven to rotate, a pair of lenses 33, 34, and a pair of reflection mirrors 35, 36. The laser beam L emitted from the laser scanner unit 30 can form the electrostatic latent image on the photosensitive drum 20. Because the laser scanner unit 30 is disposed below the photosensitive drum 20, the length of the image forming device in the sheet-transport direction can be reduced so that the laser printer 1 can be provided in a more compact size. Also, the laser scanner unit 30 can emit the laser light L to form the electrostatic latent image on the surface of the photosensitive drum 20 without interference with the sheets transported in the sheet-transport pathway PP.

With respect to a rotational direction of the photosensitive drum 20, at a position upstream of the irradiating portion of the laser beam L, a scorotoron type charger 40 is provided for emitting a corona discharge from a charge wire such as a tungsten wire. The charger 40 is held out of contact with the photosensitive drum 20. In the depicted embodiment, because the photosensitive drum 20 is made of a material having a positively chargeable characteristic, the charger 40 is imparted with voltage of positive polarity.

At a position upstream of the charger 40, a discharge lamp 41 is provided. The discharge lamp 41 is provided by a light source, for example, a LDE (laser emitting diode), an EL (electroluminescence) and a fluorescent lamp. The discharge lamp 41 is adapted for removing residual charge remaining on the photosensitive drum 20 after transfer operation in order to prevent the residual charge from affecting on the a subsequently formed electrostatic latent image so as to avoid degradation of a resultant output image formed on the sheet P.

At a position upstream of the discharge lamp 41, a toner leveling brush 42 is provided whose tips are in contact with the photosensitive drum 20 for leveling the residual toners remaining thereon.

Next, will be described the developing unit 50 disposed immediately behind the photosensitive drum 20. The developing unit 50 includes a developing case 4 and a double-cylindrical toner box 51 detachably mounted within the developing case 4. A drivingly rotatable agitator 52 and toners 53 are contained in the toner box 51. A toner-supply port 51*a* is formed in the toner box 51. A toner-storage chamber 54 is provided at a front side of the toner box for storing therein the toners 53 supplied from the toner box 51 through the toner-supply port 51*a* by rotation of the agitator 52. A toner-supply roller 55 is rotatably supported in the toner-storage chamber 54 and extends in a horizontal direction. A developing roller 56 is rotatably supported in contact with both the toner supply roller 55 and the photosensitive drum 20. The developing roller 56 extends in the horizontal direction so as to form a front wall of the toner-storage chamber 54.

The toner is formed of polymerized material such as styreneacryl, which may be pulverized toner or a spherically shaped toner. Particle size of the toner 53 is in a range of from 6 to 12 $\mu$m, preferably from 7 to 10 $\mu$m in case of the pulverized toner. In the illustrated embodiment, the toner 53 is made of electrically insulative material so as to avoid leakage of the developing bias voltage from the developing roller 53 to the photosensitive drum 20 due to electrical discharge.

The toner 53 includes a base toner and an additive added to the base toner. Silica is used as the additive for imparting the resultant toner with fluidity. The base toner contains resin, wax, carbon black and CCA (charge control agent). Silica which is the example of the additives is a surface quality changing agent of the toner in order to enhance fluidity of the toner 53.

Further, the additive can be provided with toner blocking preventing function, cleaning enhancement function, less damaging function to the photosensitive drum, image density improving function, and image quality improving function in addition to the enhancement of fluidity. Minute powders of colloidal silica, titanium oxide, and aluminum oxide (alumina) are available as additives other than silica.

The toner-supply roller 55 is formed of a foamable elastic material such as silicone rubber and polyurethane rubber having electrical conductivity. A resistance at a contacting portion with the developing roller 56 is set to about $5\times10^4$ to $1\times10^9$ Ohms.

The developing roller 56 has a relatively high hardness having electrical conductivity, and is formed of silicone rubber, urethane rubber or NBR. A resistance value bridging between a central electrode to which developing bias voltage is applied and an outer peripheral contacting surface portion is in a range of from about $5\times10^4$ to $1\times10^7$ Ohms. More specifically, the surface portion of the developing roller in contact with the photosensitive drum 20 at the nip portion is formed of an ionic conductive material. The example of the material is urethane elastomer material. Accordingly, during developing process, developing bias voltage can be applied to the developing roller 56 made of the ionic conductive material by biasing means. Such a developing roller 56 is produced by uniformly mixing prepolymer of liquidized urethane elastomer with cross-linking agent and liquid ammonium salt for imparting the ionic conduction, then solidifying the mixture by casting the mixture into a mold, and then grinding a surface of the solidified product to provide surface dimension accuracy.

In the developing roller 56 thus constructed, because the developing roller 56 is moved in a direction opposite the moving direction of the photosensitive drum 20 at the nip portion, even if the developing roller 56 is brought into direct contact with the photosensitive drum 20 due to the full adhesion of the toners 53, which serve as the electrically insulative materials, onto the photosensitive drum 20 at the upper portion of the nip portion in case of solid black printing, electrical discharge at the nip portion may scarcely occur because the photosensitive roller 56 is formed of the ionic conductive material. Accordingly, it is possible to reduce the occurrence in that the developing bias voltage applied to the developing roller is leaked to the photosensitive drum 20 to render the surface voltage of the photosensitive drum 20 unstable. As a result, by enhancing the developing efficiency to about not less than 90%, that is, by providing approximately almost 100% of the developing efficiency, even if the toners 53 scarcely remain at the nip portion in case of the solid black printing, it is possible to reduce the occurrence in that the developing bias voltage applied to the developing roller is leaked to the photosensitive drum 20 to render the surface voltage of the photosensitive drum 20 unstable. Incidentally, if electrically conductive toners are used, electrical discharge between the developing roller 56 and the photosensitive drum 20 does not easily occur regardless of the existence of the toners at the nip portion. Thus, in this case also, it is possible to reduce the occurrence where the developing bias voltage applied to the developing roller is leaked to the photosensitive drum 20 to render the surface voltage of the photosensitive drum unstable. Incidentally, impression developing operation is performed by pressing the developing roller 56 onto the photosensitive drum 20 at a load of 500 g respectively at the axial end portions of the roller by using a spring.

Further, by imparting the toner with the electrically insulative characteristic, co-operation of the toners 53 remaining at the nip portion by a slight amount and the developing roller 56 made of ionic conductive material will effectively prevent electrical discharge from the developing roller 56 to the photosensitive drum 20. However, it may be possible to avoid the electrical discharge from the developing roller 56 to the photosensitive drum 20 by the function of the developing roller only which is made of the ionic conductive material, while the toner 53 is made of the electrically conductive material.

Figure 14:
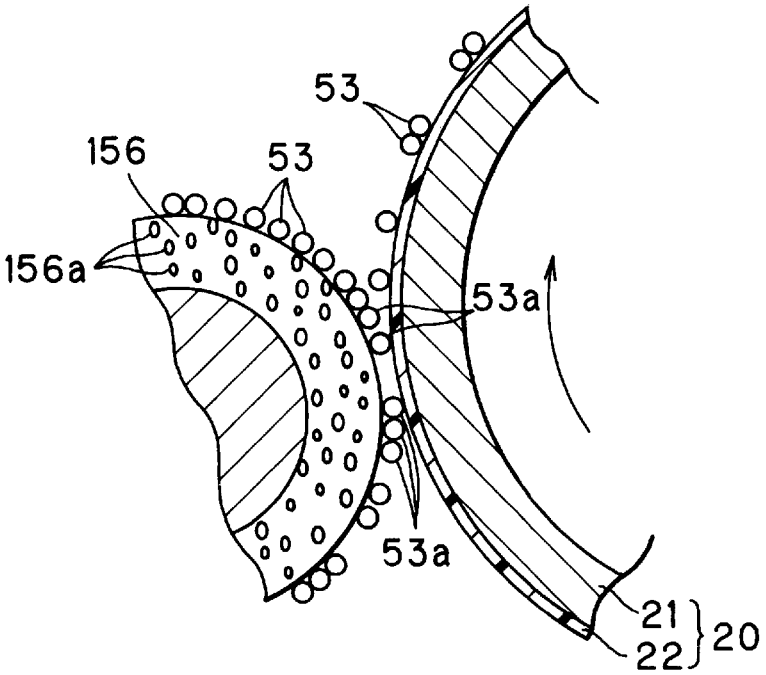
FIG. 14 is an enlarged schematic cross-sectional view showing details of a developing roller and a photosensitive drum in a comparative example where toners exist at a nip portion.
Figure 15:
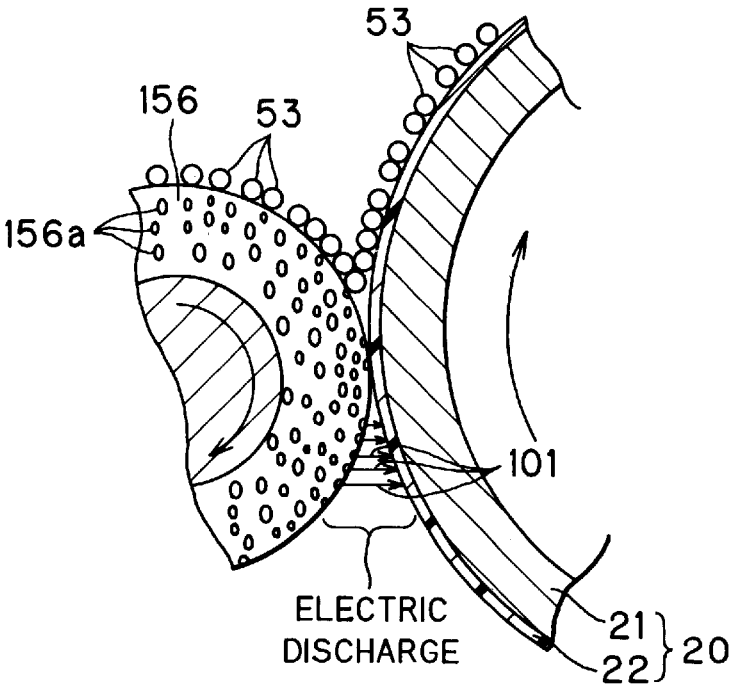
FIG. 15 is an enlarged schematic cross-sectional view showing details of the developing roller and the photosensitive drum in the comparative example where toners do not exist at the nip portion.

Here, as a comparative example, as shown in FIGS. 14 and 15, is provided a developing roller 156 whose surface portion is imparted with electrical conductivity by dispersion of carbon particles 156*a* at the surface portion of the developing roller. Other conditions are the same as those of the depicted embodiment. The developing roller 156 is moved in a direction opposite the moving direction of the photosensitive drum 20 at the nip portion, and further, the developing efficiency of about 100% is set. Under such condition, as far as large amount of toners remain at the nip portion in a developing operation in contrast to the solid black printing, leakage of the developing bias voltage due to the electrical discharge from the developing roller 156 to the photosensitive drum 20 may not easily occur because large amount of toners 53*a* serving as electrically insulative material exist. Accordingly, developing is performed while maintaining stable surface voltage on the photosensitive drum 20. On the other hand, if solid black printing is to be performed under such condition, the toners servings as the electrically insulating materials have already been adhered to the photosensitive drum before the toners 53 reach the nip portion. Therefore, toners 53 scarcely remain at the nip portion. Thus, the developing roller 156 is brought into direct contact with the photosensitive drum 20. Consequently, as shown in FIG. 15, the developing bias voltage applied to the developing roller 156 will easily cause electrical discharge as indicated by an arrow 101, since the carbon powders 156*a* contained in the developing roller 156 become nuclei of the electrical discharge. Accordingly, the surface voltage on the photosensitive drum 20 becomes unstable due to the leakage, so that degraded printing results. In other words, by the dispersion of the carbon particles 156*a*, uneven distribution of the electrical resistance value may be provided at the surface of the developing roller 156. Therefore, electrical discharge may easily occur from the low electrically resistant portion, i.e., from the carbon particles 156*a*. Thus, in view of the comparative example shown in FIG. 15, it is apparent that the developing roller 56 according to the depicted embodiment is advantageous in view of the setting of high developing efficiency and formation of high quality image.

As shown in FIG. 5, a direct current voltage source E which is an example of the biasing means is connected to the developing roller 56 so that the developing biasing voltage is supplied thereto. The developing bias voltage is set into a predetermined value so that the electrical discharge does not occur from the surface portion of the developing roller 56 to the photosensitive drum 20. The predetermined value is obtained by experience or experiment or computer simulation after setting specific structures of the developing roller 56 and the photosensitive drum 20. As a result, electrical discharge from the developing roller 56 to the photosensitive drum 20 can be reliably avoided.

The developing roller 56 is adapted for performing developing operation using the tones 53 in co-operation with the photosensitive drum 20, and for collecting the residual toners.

More specifically, provided that the residual toners are carried on the photosensitive drum 20, the residual toner amount being about 10% of entire toner amount prior to transfer operation, and such photosensitive drum 20 is exposed to laser beam by the laser scanner unit 30 so that the laser beam sufficiently reaches beneath the residual toners 53. Then, in the developing unit 50, by utilizing potential difference between an exposed portion and non-exposed portion regardless of the existence of the residual toners on the photosensitive drum 20, the residual toners 53 are moved to or collected by the developing rollers 56 if the residual toners 53 are affixed on the non-exposed portion of the photosensitive drum 20. Simultaneously, the residual toners 53 are maintained to be affixed (developed) on the photosensitive drum 20 if the residual toners have already been affixed to the exposed portion of the photosensitive drum 20. Concurrently, positively charged toners 53 are moved (developed) from the developing roller 56 to the photosensitive drum 20 if the residual toners 53 have not been affixed to the exposed portion of the photosensitive drum 20. That is, developing cycle and toner collecting cycle are performed concurrently.

As shown in FIG. 2, the toner-storage chamber 54 is formed with a relatively large open space S above the toner supply roller 55. Therefore, even when a great deal of toner 53 is supplied from the toner box 51 through the toner-supply port 51*a* into the toner-storage chamber 54, toner 53 will not become compressed in the toner-storage chamber 54. Therefore, the toner 53 will constantly be in a fluffed condition which can provide sufficient fluidity. This allows the supply roller 55 to stably supply toner.

The resilient thickness-regulating blade 57 in the form of a thin-plate shape and made from stainless steel or phosphor bronze is dependingly attached to the developing case 4. The thickness-regulating blade 57 has a lowermost bending portion in pressing contact with the developing roller 56. The thickness-regulating blade 57 regulates thickness of the layer of the toners 53 supplied from the toner supply roller 55 and adhering in a layer to the surface of the developing roller 56 to a predetermined thickness of from one toner particle to less than two particles, that is, to about 7 to 12 $\mu$m thick which is equivalent to about from 0.4 to 0.5 mg/cm$^2$ with respect to the amount of the toners on the developing roller 56. To this effect, bent portion of the thickness regulation blade has a radius of curvature of about from 0.3 to 0.4 mm to insure a toner amount of from 0.4 to 0.5 mg/cm$^2$. With this arrangement, the toner layer formed on the developing roller 56 contains from one to less than two toner particles in a thickness direction thereof, and therefore, the toners which have not been used for the developing operation are not deposited at a contacting portion between the developing roller and the photosensitive drum 20, and the toners are surely adhered to the developing roller 56 for their recovery.

Incidentally, developing bias and rotation number of the developing roller 56 will determine the minimum amount of toners on the developing roller 56. For example, if the toner amount on the developing roller is about 0.3 mg/cm$^2$, developing operation can be made with a sufficient toner density by using an ordinarily available developing bias and rotation numbers of the developing roller 56.

Figure 9:
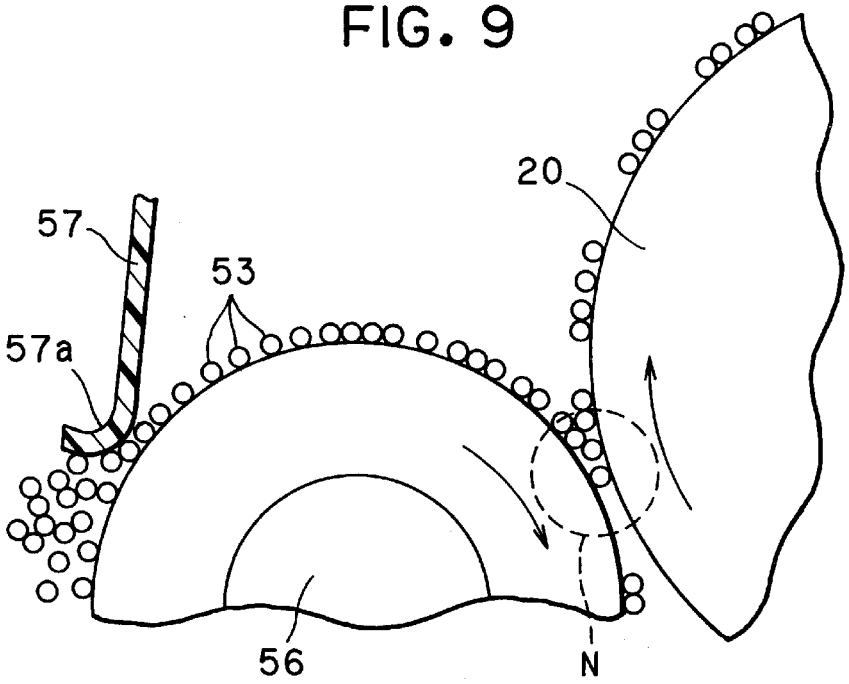
FIG. 9 is an enlarged side view showing a developing roller, a thickness regulation blade and the photosensitive drum according to the first embodiment.

As shown in FIG. 9, the toner layer contain one to less than two toner particles in the radial direction of the developing roller 56 by the function of the thickness regulation blade 57. As a result, after the regulation of thickness of the toner layer, almost all the toners are in contact with the developing roller 56. Consequently, the toners are adhered to the developing roller 56 even at the nip portion N where the developing roller 56 is in rubbing contact with the photosensitive drum 20, and therefore, toner stagnation does not occur at the portion above the nip portion N and toners are not peeled off from the developing roller 56 because of the physical force due to the contact between the photosensitive drum 20 and the developing roller 56.

Figure 10:
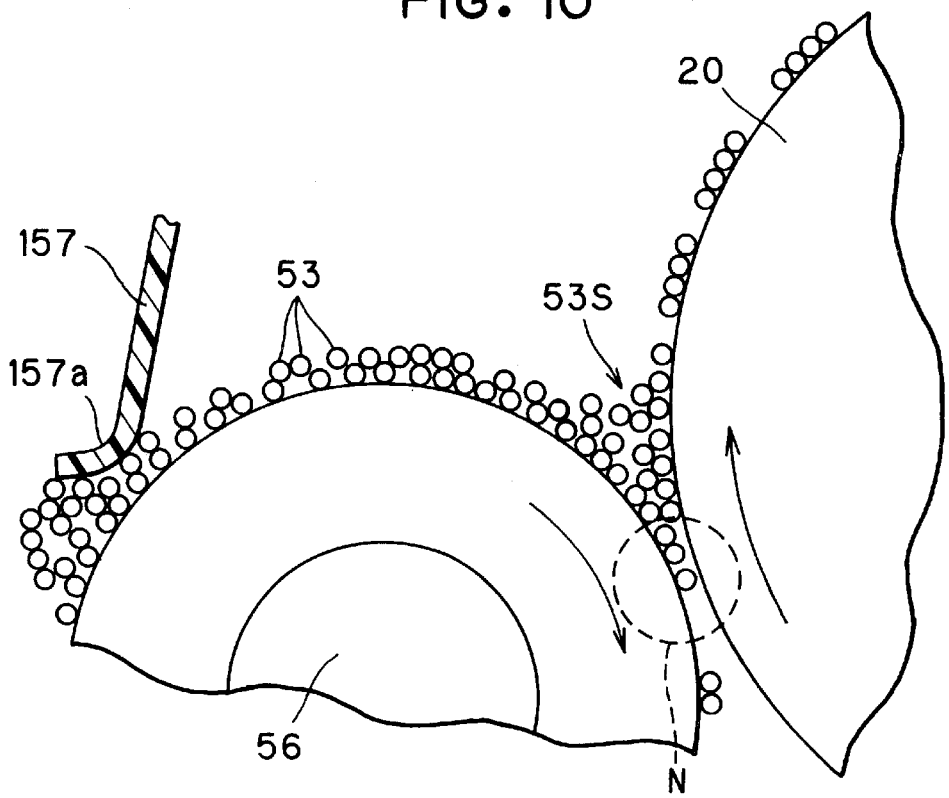
FIG. 10 is an enlarged side view showing a developing roller, a thickness regulation blade and a photosensitive drum in a comparative example.

On the other hand, FIG. 10 shows a comparative example in which a thickness regulation blade 157 has a bending portion 157*a* which has a radius of curvature greater than that of the bending portion of the thickness regulation blade 57 in order to carry toners on the developing roller 56 by an amount exceeding 0.5 mg/cm$^2$. In FIG. 10, the thickness of the toner layer is such that not less than two particles are deposited on the developing roller 56 in the radial direction thereof, i.e., in the thickness direction of the toner layer. As a result, in the comparative example, after the thickness regulation by the thickness regulation blade 157, large amount of toners are not in contact with the developing roller 156. Therefore, at the portion above the nip portion N toner stagnation 53S may occur. As is apparent from FIGS. 9 and 10, the present embodiment is extremely advantageous in preventing the toners from their deposition.

The photosensitive drum 20 is driven to be rotated in the clockwise direction by the first drive mechanism 80 described later, and the toner supply roller 55 and the developing roller 56 are driven to be rotated in the clockwise direction by the second drive mechanism 100 described later. In other words, the peripheral surface of the developing roller and the peripheral surface of the photosensitive drum are moved in opposite directions at the nip portion therebetween. With this configuration, as shown in FIG. 5, the toner supply roller 55 and the developing roller 56 scrape against each other, and the thickness regulation blade 57 pressingly abrades against the developing roller 56. The scraping and abrading action positively charges individual toner 53. The positively charged toner 53 adhere to the electrostatic latent image formed on the surface of the photosensitive drum 20 by the laser beam L, thereby performing reversal developing.

Further, because of the above rotational relationship between the developing roller and the photosensitive drum, vivid mobility of the toners at a position adjacent the nip portion can be provided, so that Van der Waals attraction force can be canceled, and toner can be moved only by the electrical field applied between the developing roller and the photosensitive drum. Accordingly, not only the spherical toners but also the pulverized toners can be used. Moreover, because of the above rotational relationship between the developing roller and the photosensitive drum, it is possible to perform developing operation at a position immediately upstream of the nip portion in the rotational direction of the developing roller 56 and to perform toner collection at a position immediately downstream of the nip portion in the rotational direction of the developing roller, to thus facilitate toner collecting operation by the developing roller 56 for re-using the collected toners.

The transfer roller 60 is rotatably disposed above and in contact with the photosensitive drum 20. The transfer roller 60 is formed from foamable elastic material and having electrical conductivity such as silicone rubber, polyurethane rubber and EPDM. The resistance value where the transfer roller contacts the photosensitive drum 20 is set to about $1\times10^{6}$ to $1\times10^{10}$ Ohms. In transferring the toners 53 on the photosensitive drum 20 onto the sheet P, the transfer roller 60 is applied with a transfer bias voltage having a polarity (negative polarity) reverse to that of the toners 53. The resistance value is relatively large so that even though the transfer roller 60 contacts the surface of the photosensitive drum 20, the voltage applied to the transfer roller 60 will not destroy the photoconductive layer 22 formed on the photosensitive drum 20 yet the toner image on the photosensitive drum 20 can be reliably transferred onto the sheet P.

On the photosensitive drum 20 after the transfer operation, residual toners exist which have not been transferred onto the imaging portion of the sheet. The residual toners are successively absorbed and collected by the developing roller 56 of the developing unit 50 and are returned to the toner accumulation chamber 54 for re-use in the subsequent developing operation. The residual toners remain at a portion corresponding to an imaging region. Particularly, greater amount of toners locally remain at the line imaging portion rather than solid black imaging portion. If large amount of residual toners locally remain, it would be difficult to absorb and collect these toners by the developing roller 56. Therefore, in the depicted embodiment, a toner leveling brush 42 is provided in contactable with the residual toners remaining on the photosensitive drum 20 at a position downstream of the transfer roller 60 in the rotational direction of the photosensitive drum 20 in order to level the residual toners. By leveling the residual toners, collection of the toners by the developing roller 56 can be promoted.

The fixing unit 70 is provided downstream in the sheet-transport direction of the photosensitive drum 20. The fixing unit 20 includes a heat roller 71 housing therein a conventional halogen lamp and a press roller 72. A sheet P with the toner image transferred onto its lower surface is heated and pressed between the heat roller 71 and the press roller 72 so that the toner image is fixed onto the sheet P. A pair of transport rollers 75 and the discharge tray 77 are provided downstream in the sheet-transport direction from the fixing unit 70.

In the depicted embodiment, as shown in FIG. 1, a combination of the sheet supply roller 13, the photosensitive drum 20, the fixing unit 70, and the discharge tray 77 constitutes a substantially linear sheet transport pathway PP starting from the sheet cassette 14.

Because the sheet transport pathway PP has generally linear extension, the laser printer can perform image formation regardless of the kind of the sheet P. For example, printing can be effected on the sheet of thick and linearly orienting characteristic such as thick sheet, envelope and OHP sheet. However, these sheets provide low transferring efficiency in comparison with a plain paper, amount of residual toners remaining on the photosensitive drum 20 may be increased. Therefore, if the toner absorbing and collecting efficiency of the developing roller 56 is insufficient, the above described ghost may be generated. Accordingly, in the device providing the linear sheet transport pathway PP, the developing roller 56 must provide high toner recovering efficiency.

Figure 3:
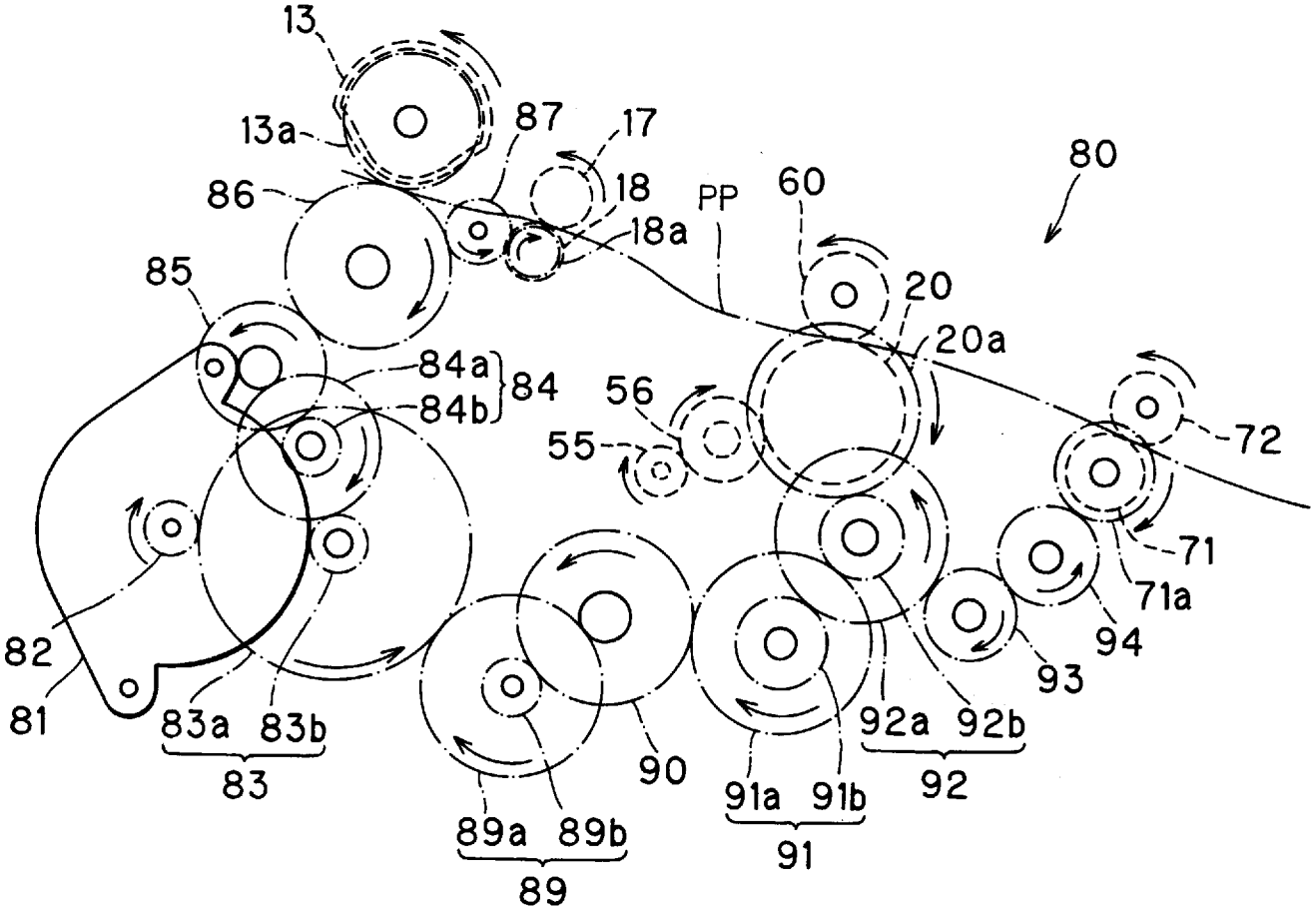
FIG. 3 is a view showing gear trains of a first drive mechanism according to the first embodiment.

Next, will be described the first drive mechanism 80 for driving the photosensitive drum 20 and the sheet transporting system with reference to FIG. 3. The first drive mechanism 80 is disposed at an outer surface of a left side wall of the laser printer 1. In the first drive mechanism 80, a first drive motor 81 has an output shaft to which a gear 82 is mounted. The rotation of the gear 82 is transmitted to a gear 85 through two stage gears 83 (83*a*, 83*b*) and two stage gears 84 (84*a*,84*b*). The rotation of the gear 85 is transmitted to a gear 13*a* which drive the sheet supply roller 13 through a gear 86. Further, the rotation of the gear 86 is transmitted to a gear 18*a* which drives the resist roller 18 through a gear 87. The rotation of the two stage gears 83 is transmitted to a gear 20*a* which drives the photosensitive drum 20 through two stage gears 89 (89*a*,89*b*), a gear 90, two stage gears 91 (91*a*,91*b*) and two stage gears 92 (92*a*,92*b*).

On the other hand, rotation of the two stage gears 92 is transmitted to a gear 71*a* which drives the heat roller 71 through a gears 93 and 94. That is, upon rotation of the first drive motor 81 in a clockwise direction, the sheet supply roller 13, the pair of resist rollers 17, 18, the photosensitive drum 20 and the heat roller 71 are rotatingly driven in directions indicated by arrows. Therefore, the sheet P fed from the sheet cassette 14 is transported along the predetermined sheet transport pathway PP and is discharged onto the discharge tray 77.

Figure 4:
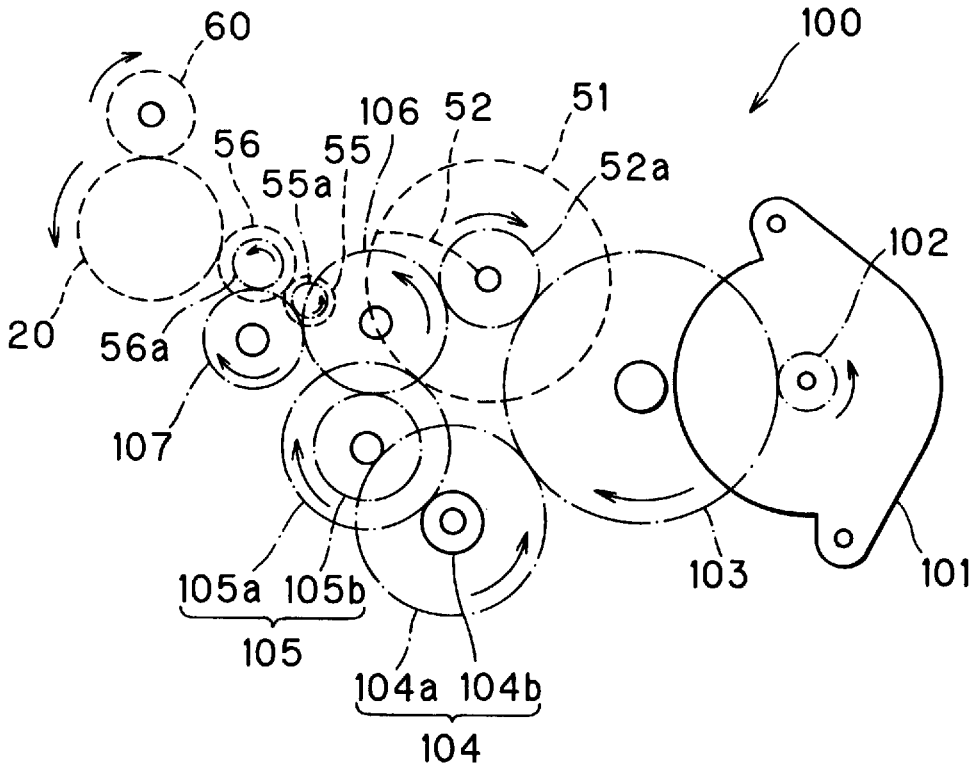
FIG. 4 is a view showing gear trains of a second drive mechanism according to the first embodiment.

Next, will be described the second drive mechanism 100 for driving the developing unit 50 with reference to FIG. 4. The second drive mechanism 100 is disposed at an outer surface of a right side wall of the laser printer 1. In the second drive mechanism 100, a second drive motor 101 has an output shaft to which a gear 102 is mounted. The rotation of the gear 102 is transmitted to a gear 52*a* which drives the agitator 52 disposed in the toner box 51 through a gear 103, two stage gears 104 (104*a*, 104*b*), two stage gears 105 (105*a*,105*b*), and a gear 106. The rotation of the gear 106 is transmitted to a gear 56*a* which drives the developing roller 56 and to a gear 55*a* which drives the toner supply roller 55 through a gear 107.

Upon rotation of the second drive motor 101 in a counterclockwise direction, the agitator 52, the toner supply roller 55 and the developing roller 56 are rotated in directions indicated by arrows. Accordingly, the toners 53 accumulated in the toner box 51 are supplied to the toner supply roller 55 by the rotation of the agitator 52, and simultaneously, the toners 53 are supplied to the developing roller 56 by the rotation of the toner supply roller 55. The photosensitive drum 20, the developing roller 56 and the toner supply roller 55 are rotated in the same direction. Further, driving speed of the first and second drive motors 81 and 101 are determined such that the peripheral speed of the developing roller 56 is not less than twice as high as the peripheral speed of the photosensitive drum 20.

Next, developing operation and effect according to the reversal developing method will be described under the specific developing condition.

Figure 6:
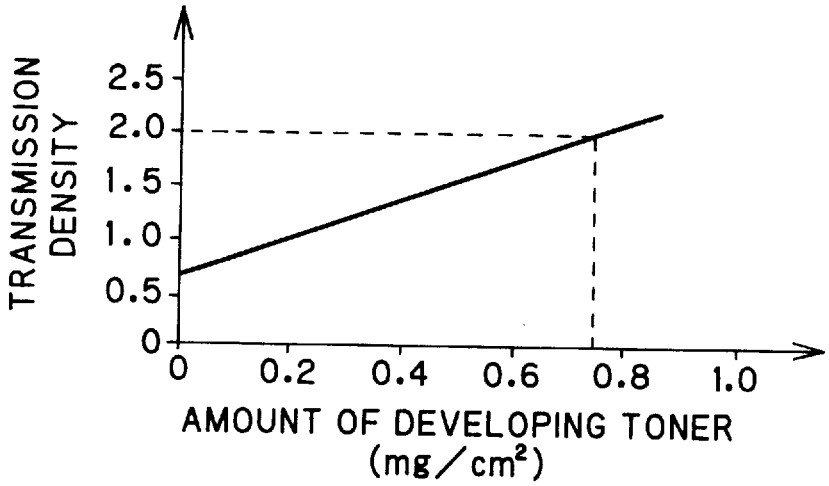
FIG. 6 is a graph showing the relationship between transmission density and amount of developing toner.

In FIG. 1, the photosensitive drum 20 is driven to be rotated in the clockwise direction by the first driving mechanism 80. Also, the toner supply roller 55 and the developing roller 56 are driven to be rotated in the clockwise direction by the second driving mechanism 100. With this configuration, as shown in FIG. 6, the toner supply roller 55 and the developing roller 56 scrape against each other. Also, the thickness-regulating blade 57 pressingly abrades against the developing roller 56. The scraping and abrading action positively charges individual toner 53. The positively charged toner 53 adheres to the electrostatic latent image formed on the surface of the photosensitive drum 20 by the laser beam L, thereby performing reversal developing.

As shown in FIG. 6, in order to obtain a transmission density (image density) of 2.0, the amount of toner adhering to the surface of the sheet needs to be about 0.78 mg/cm$^2$. On the other hand, if all toners on the developing roller 56 are transferred to the photosensitive drum 20 (this implies developing efficiency of 100%) in case of the solid black printing, no toners exist at the nip portion because the developing region A is positioned upstream of the nip portion in the rotational direction of the developing roller. As a result, the developing roller 56 having relatively large friction coefficient and the photosensitive drum 20 are in direct contact with each other at the nip portion, which is disadvantageous.

That is, in the depicted embodiment, the photosensitive drum 20 and the developing roller 56 are rotated in the same rotational direction, so that these are relatively moved in the opposite direction at the nip portion. In this case, if all toners 53 on the developing roller 56 are transferred to the photosensitive drum 20 in the developing region A shown in FIG. 5 before the toners reach the nip portion at the developing efficiency of 100%, the developing roller 56 is brought into direct contact with the photosensitive drum 20 at the nip portion. Since the friction coefficient of the developing roller 56 is extremely larger than that of the photosensitive drum 20, rotation of the developing roller 56 and the photosensitive drum 20 become unstable, to degrade output imaging quality. In this connection, the development efficiency is set to about 60 to 90% in order to prevent the toners 53 from being fully used up at the nip portion N.

Total amount of the toners(toner transfer amount) to be transferred to the developing region by the developing roller 56 is represented by multiplying toner weight per unit area by peripheral speed of the developing roller. In the depicted embodiment, the toner transfer amount is set greater than the required toner amount of 0.78 mg/cm$^2$ which is considered to provide sufficient imaging density. To this effect, the present embodiment has a structure capable of existing toners 53 as lubricant at the nip portion between the photosensitive drum 20 and the developing roller 56.

If the thickness-regulating blade 57 regulates the toner amount on the developing roller 56 to 0.4 mg/cm$^2$ and, a development efficiency is set to about 100 percent, and peripheral velocity of the developing roller 56 is set twice as high as the peripheral velocity of the photosensitive drum 20 in case of the solid black printing, the surface portion of the developing roller 56 is brought into direct contact with the photosensitive drum 20 without intervening the toner 53 at the nip portion. In this case, because the developing roller 56 is formed of the ionic conductive material, the electrical discharge at the nip portion does not easily occur. Accordingly, it is possible to reduce the occurrence where the developing bias voltage applied to the developing roller 56 is leaked to the photosensitive drum 20 due to the electrical discharge to render the surface voltage of the photosensitive drum 20 unstable.

Incidentally, in order to obtain necessary toner amount of about 0.78 mg/cm$^2$ on the photosensitive drum 20 while carrying the toners on the developing roller 56 by the amount of about 0.5 mg/cm$^2$, peripheral speed of the developing roller 56 should be about 1.7 times as high as the peripheral speed of the photosensitive drum 20 if the developing efficiency of about 90% is set, and peripheral speed of the developing roller 56 should be about 2.6 times as high as the peripheral speed of the photosensitive drum 20 if the developing efficiency of about 60% is set. In this way, peripheral speed is adjusted in accordance with the developing efficiency.

Figure 7:
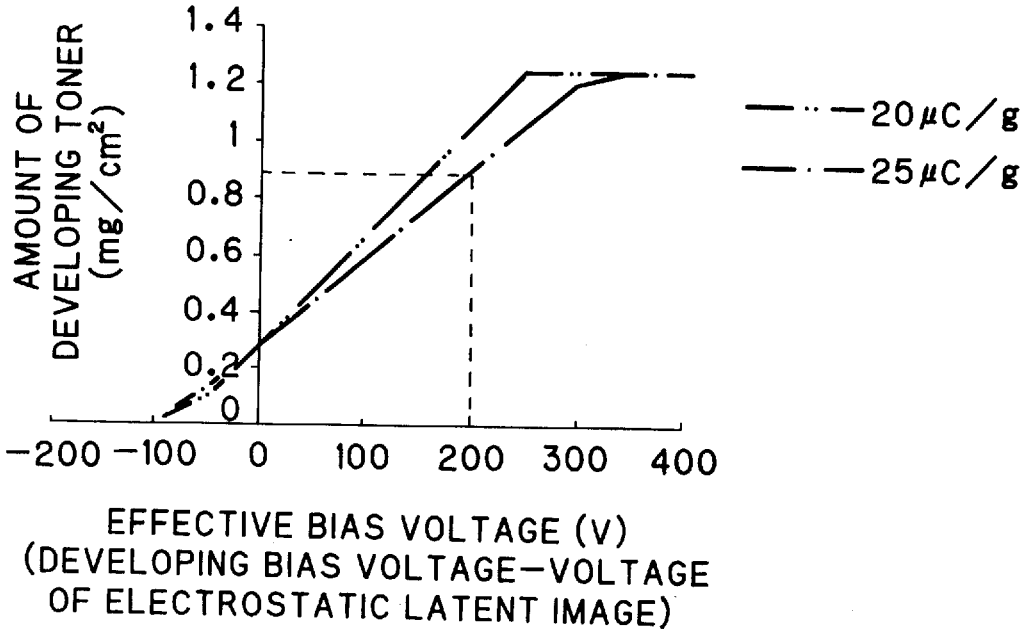
FIG. 7 is a graph showing the relationship between amount of developing toner and an effective bias voltage.

FIG. 7 shows a graph indicating developing characteristic according to the present embodiment.

The developing characteristic in the reversal developing is characterized by linearity between the developing toner amount and the effective developing bias voltage(difference between the developing bias voltage and electrostatic latent image voltage after exposure). This linearity is saturated when developing efficiency becomes 100%. Thereafter, developing toner amount is not increased in spite of the increase in effective developing bias voltage.

On the other hand, as shown in FIG. 7, slope of the developing characteristic is related to the charging amount of the toners. As shown by a dotted chain line in FIG. 7, if the charging amount of the toner is increased (25 $\mu$C/g), slope angle of the developing characteristic becomes small, and therefore, developing efficiency of 100% can not be provided unless the effective developing bias voltage is increased. Reversely, as shown by two dotted chain line shown in FIG. 7, if the charging amount of the toner is lowered (20 $\mu$C/g), slope angle of the developing characteristic becomes large, and therefore, developing efficiency of 100% can be obtained with less effective developing bias voltage.

Incidentally, in the depicted embodiment, if developing efficiency of 100% is provided, it is necessary to increase charging amount of the toners so as to permit the developing characteristic to have small slope angle. To be more specific, the first and second drive mechanisms 80 and 100 are constructed in order to provide toner amount of 0.5 mg/cm$^2$ on the developing roller 56 and to provide toner charging amount of from 20 to 25 $\mu$C/g(this range should be maintained irrespective of variation in ambient environment and variation in durability test), and to set the peripheral speed of the developing roller 56 2.5 times as high as the peripheral speed of the photosensitive drum 20. FIG. 7 shows the developing characteristics taking these requirement into consideration.

For example, if effective developing bias voltage of the developing roller 56 is set to 200 V, it is possible to maintain image density of not less than 2.0 while preventing the developing efficiency from being 100% in spite of the variation of the toner charging amount from 20 to 25 $\mu$C/g. In this case, since the electrostatic latent image voltage after exposure applied to the photosensitive drum 20 is 100 V, the developing bias voltage supplied from the developing power source E to be applied to the developing roller 5 is set to 300 V.

The charging amount of the toner 53 depends on the temperature and humidity of the ambient environment. For example, in a low temperature and a low humidity environment of 10 degrees C. and 20 percent humidity, the charge amount can be about 25 $\mu$C/g. This can decrease to about 20 $\mu$C/g at high temperature and high humidity conditions of about 32 degrees C and 80 percent humidity. As shown in FIG. 7, in order to obtain the predetermined developing toner amount of approximately 0.90 g/cm$^2$ at the developing efficiency of about 70% in the low temperature and low humidity environment or in the high temperature and high humidity environment, under the condition that the developing roller 56 is driven in the same rotational direction as the photosensitive drum 20, the effective developing bias voltage of the developing roller 56 needs to be set to about 200 volts.

Incidentally, the developing bias voltage, for example, 300 V, is the predetermined value set in a voltage range where electrical discharge does not occur from the surface portion of the developing roller 56 to the photosensitive drum 20. In this case, in case of the solid black printing, the surface portion of the developing roller 56 may be in direct contact with the photosensitive drum 20 without intervening the toners 53 at the nip portion. However, because the developing roller 56 is formed of the ionic conductive material, and the developing bias voltage is set into the predetermined value (about 300 V), no electrical discharge occurs from the surface portion of the developing roller 56 to the photosensitive drum 20.

Figure 8:
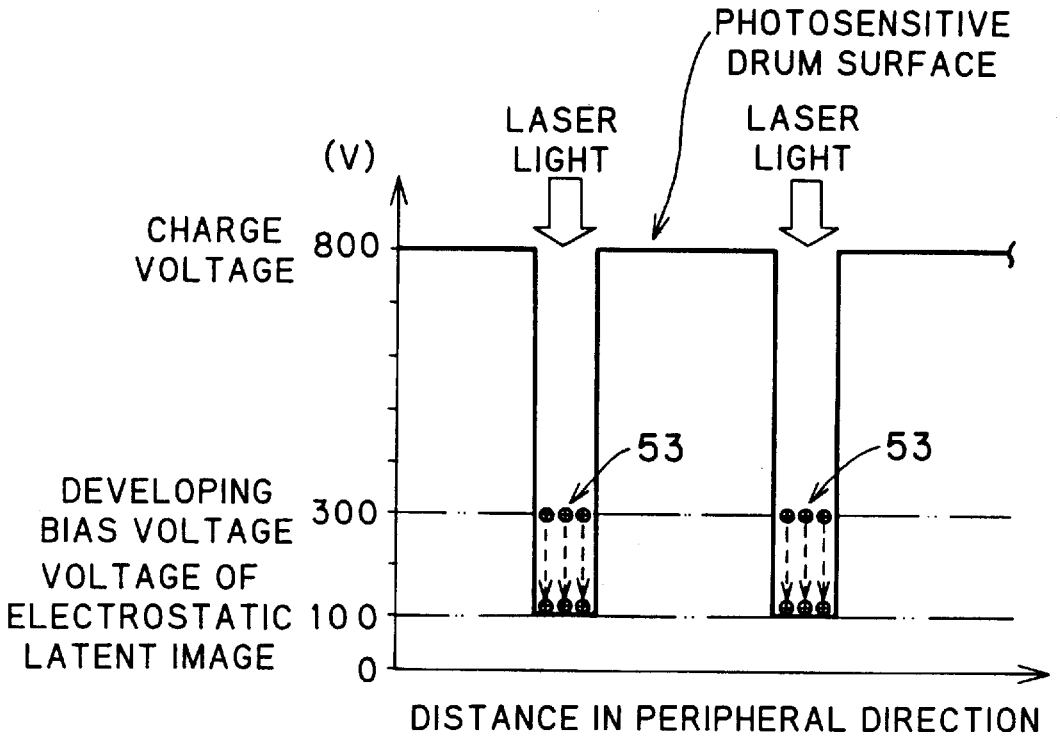
FIG. 8 is a graphical representation for description of the developing process in the reversal developing process.

When image forming processes are started, any charges remaining on the surface of the photosensitive drum 20 are removed by the discharge lamp 41. Then, as shown in FIG. 8, the charger 40 applies a uniform charge of about 800 volts to the surface of the photosensitive drum 20. The laser emitting unit 31 emits a laser beam L which corresponds to image data based on an image to be printed on the sheet P. The laser beam L is scanned in a main scanning direction by the polygon mirror 32. The laser beam L then irradiates the surface of the photosensitive drum 20, after passing through the lenses 33, 34 and reflecting off the reflecting mirror 35, 36, to form the electrostatic latent image on the surface of the photosensitive drum 20. Voltage at the surface of the photosensitive drum 20 formed with the electrostatic latent image drops to about 100 volts.

Because positively charged toner 53 is adhering in a thickness of about from one toner particle to less than two particles to the surface of the developing roller 56 while a developing bias voltage of about positive 300 volts is applied to the developing roller 56, the toner 53 is attracted to the voltage lower then itself, that is, to the electrostatic latent image voltage, which is about positive 100 volts, rather than to the high charge voltage of about 800 V. Therefore, the toner 53 from the developing roller 56 are moved to only a portion where the electrostatic latent image is formed on the surface of the photosensitive drum 20 in such a manner that the latent image portion is buried with the charges of the toners depending on the difference between the electrostatic latent image voltage and developing bias voltage (effective developing bias voltage).

This phenomena appears at the developing region A shown in FIG. 5. That is, since the developing roller 5 and the photosensitive drum 20 are moved in directions opposite to each other at the nip portion, the toners 53 on the photosensitive roller 56 are transferred to the electrostatic latent image portion on the photosensitive drum at the developing portion A, which is positioned immediately upstream of the nip portion in the rotational direction of the developing roller.

On the other hand, residual toners remaining on the photosensitive drum after transfer operation are moved in accordance with the potential produced by the developing bias voltage, similar to the toners 53 on the developing roller 56. The residual toners 53 are beforehand charged by the charger 40 to the charging voltage of +800 V. If laser beam L is irradiated on a portion where the residual toners are affixed, the voltage of the residual toners are reduced to +100 V similar to the electrostatic latent image voltage. Therefore, new toners are adhered by the developing roller 56 to the portion where the residual toners had been adhered. Accordingly no problem occurs even if the residual toners remain on the photosensitive drum 20 after developing operation.

However, the residual toners affixed to a non-exposed portion are still charged with +800 voltage. If these residual toners are positioned close to the nip portion, the residual toners are moved to the developing roller 56 and are collected thereby because of the difference between the charging voltage (+800 V) and the developing bias voltage (+300 V). Incidentally, process for simultaneous developing and collection by way of the developing roller 56 is described in detail in "Electrophotography academy magazine Vol. 30 No. 3 (1991) P29" by Hosoya et al.

The residual toners tend to remain on the photosensitive drum by Van der Waals attraction relative to the photosensitive drum 20 in addition to the developing bias voltage. In the illustrated embodiment, since the photosensitive drum 20 and the developing roller 56 are moved in direction opposite to each other at the nip portion, the developing roller 56 provides residual toner scraping function. Since the residual toners are moved by the scraping action, Van der Waals attraction bridging between the toners and the surface of the photosensitive drum 20 can be canceled. Thus, the residual toners can be easily attracted to the developing roller 56 because of the developing bias voltage. Accordingly, toners do not remain on an non-exposed portion of the photosensitive drum 20 after completion of the developing process.

In collecting the residual toners by the developing roller 56, because the photosensitive drum 20 and the developing roller 56 are moved in the directions opposite to each other at the nip portion, the residual toners on the photosensitive drum 20 can be collected by the developing roller by the developing bias voltage at the collecting region B which is positioned immediately downstream of the nip portion with respect to the rotational direction of the developing roller 56. Therefore, the residual toners do not enter the nip portion, so that the collecting region B is not overlapped with the developing region A. Thus, toner collection can exclusively be performed at the collecting region B.

Here, as described above, the surface of the developing roller 56 is relatively moved in a direction opposite the moving direction of the surface of the photosensitive drum 20 at the most closest position therebetween (i.e., nip portion). Therefore, development of the electrostatic latent image into the toner image by the developing roller 56 is performed at a portion separately from the portion of absorption and collection of the residual toners onto the developing roller 56. I.e., the developing portion and collecting portion are located at upstream and downstream of the nip portion, respectively. Consequently, toner absorbing and collecting efficiency can be improved. Further, since the developing roller 56 is formed of an elastic material having electrical conductivity, and since the peripheral speed of the developing roller 56 is set not less than twice as high as the peripheral speed of the photosensitive drum 20, toner scraping efficiency of the developing roller 56 can be improved, to further enhance absorbing and collecting efficiency of the residual toners.

Moreover, because of the enhancement of the collecting efficiency of the residual toners, and particularly because of the provision of the toner leveling brush 42 which is in contact with the residual toners, generation of ghost can be avoided. Furthermore, generation of the ghost can be prevented because the residual toners can be desirably collected by the developing roller 56 even if printing is performed under the low temperature low humidity condition or high temperature high humidity condition onto the special sheet having low transferring efficiency such as the thick sheet and the envelope.

Furthermore, if a cleaning roller is used instead of the toner leveling brush 42, generation of ghost can be avoided even if the pulverized toners, which have been considered to be undesirable in the cleaner-less type, are used. More specifically, Instead of the toner leveling brush 42, a cleaning roller can be provided for temporarily absorbing residual toners 53 remaining on the photosensitive drum 20 after transferring operation by changing biasing voltage, and for discharging the absorbing toners 53 to the photosensitive drum 20 at a proper timing at which subsequent exposure, developing and transferring operation on the photosensitive drum 20 is not interrupted by the toners, thereby returning the toners from the photosensitive drum 20 to the developing unit 50. The cleaning roller is made of a foamable elastic material having an electrical conductivity such as a silicone rubber and polyurethane rubber to which biasing voltage is applicable.

When using the cleaning roller 42, the residual toners 53 remaining on the photosensitive drum 20 due to non-transfer to the sheet P when the sheet P is moved past the transfer roller 60 are temporarily absorbed to the cleaning roller 42 by changing biasing voltage of the cleaning roller 42. The temporarily absorbed toners 53 are then released from the cleaning roller 42 to the photosensitive drum 20 by changing the biasing voltage of the cleaning roller 42 at a proper timing at which subsequent exposure, developing and transfer operation are not interrupted by the toner releasing. Then the residual toners 53 on the photosensitive drum 20 are collected by the developing roller 56 and are subjected to recycling.

As described above, according to the first embodiment, because the photosensitive drum and the developing roller are driven in direction opposite to each other at the nip portion, the developing the latent image into the toner image is performed on the surface of the developing roller at a position upstream of the nip position in the moving direction of the developing roller, and absorption and collection of the residual toners is performed on the developing roller at a position downstream of the nip portion in the moving direction of the developing roller. Thus, formation of the toner image, and absorption and collection of the residual toners are performed at discrete positions, thereby enhancing absorbing and collecting efficiency of the residual toners.

Further, frictional coefficient at the surface of the developing roller can be increased by using the elastic roller having electrical conductivity. As a result, toner feeding efficiency can be improved, to thus enhance absorption and collection of the residual toners.

Furthermore, by providing the peripheral velocity of the developing roller not less than twice as high as the peripheral velocity of the photosensitive drum, toner scraping effect for scraping the residual toners by the surface of the developing roller can be increased, to further enhancing toner absorbing and collecting efficiency.

Further, If great amount of silica is added as additives to the toners in order to impart the resultant toners with high fluidity capable of providing high quality image (such as for example, 600 dpi), toner deposition may easily occur at the nip portion N. However, in the present embodiment, because the thickness of the toner layer is regulated by the thickness regulation blade 57 such that from one to less than two toner particles are deposited on the developing roller in the thickness direction of the toner layer, it is possible to reduce the depositing amount of the toners. In other words, stagnation of the toners at the nip portion does not hardly occur. Accordingly, printing defect such as fog can be reduced, and high quality image can be provided in spite of the employment of the toners having high fluidity capable of performing high density printing (for example, 600 dpi). Further, reduction in toner stagnation can be provided regardless of the kind of the toners such as magnetic toner, non-magnetic toner, single component type toner and two components type toner by the employment of the improved thickness regulation blade. Particularly, excellent effect can be recognized if toner having high fluidity is used.

Further, at least the surface portion, which is in contact with the photosensitive member, of the developing roller is made of ionic conductive material. Therefore, the developing bias voltage applied to the developing roller is scarcely leaked to the photosensitive drum by the electrical discharge, even if the toners scarcely remain on the nip portion due to enhancement of developing efficiency in case of solid black printing. Thus, it is possible to reduce printing defect due to unstable surface voltage on the photosensitive member, thereby providing high grade image. In other words, electrical conductivity is imparted on the developing roller by the ionic conductive material. Thus, during developing operation, developing bias voltage can be applied by the biasing means. In the above described conventional technique, since the developing roller is imparted with electrical conductivity by dispersion of electrically conductive minute powders, the electrically conductive minute powders become nuclei of the electric discharge upon application of developing bias voltage, and therefore, electrical discharge may easily occur. On the other hand, according to the depicted embodiment, ion electrical conductive material imparts electrical conductivity on the developing roller, and therefore, electrical discharge does not easily occur because no nucleus is provided for the electrical discharge. As a result, when enhancing the developing efficiency, that is, when setting the developing efficiency to a level close to 100%, it is possible to reduce the degradation of the printed image in which degradation may be caused by unstable surface voltage on the photosensitive member upon electrical discharge, even if toners scarcely remain on the nip portion in solid black printing.

Further, since the surface portion of the developing roller contains urethane elastomer as a base material and liquid ammonium salt added thereto, wear resistance and durability at the surface portion can be improved.

Further, because access to the sheet transport pathway can be made by opening the device from the upper side, sheet jamming can be easily dealt with, and sheet can be easily supplied by exposing the sheet cassette to an upper space.

Furthermore, because the transfer roller is disposed above the photosensitive member, and the laser scanner unit 30 is disposed below the photosensitive drum 20, access to the sheet transport pathway when opening the device from upper side can be easier than a case where the transfer roller is disposed below the photosensitive drum, and further, a sheet cassette can be exposed to the upper side of the device. Moreover, because the sheet passage is substantially linear, printing can be effected on the special sheets such as a thick sheet and envelope.

Next, an image forming device according to a second embodiment will be described. The second embodiment pertains to an improvement on the developing roller. Incidentally, a geometrical layout in the second embodiment is the same as that of the first embodiment, and therefore, the reference can be made on FIGS. 1, 2, 6 in connection with the first embodiment and FIGS. 11 through 13.

Figure 11:
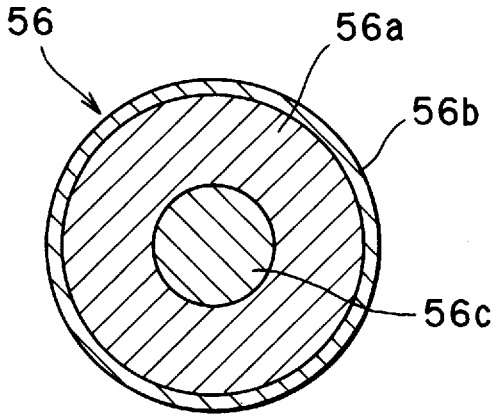
FIG. 11 is an enlarged cross-sectional view showing a developing roller in the laser printer according to a second embodiment of the present invention.

The surface of the developing roller 56 has a hardness not less than Asker-C65 degrees. More specifically, the developing roller 56 is formed of elastic roller having relatively high hardness and imparted with an electrical conductivity. Typical example is a polyurethane elastomer material having a hardness not less than Asker-C65 degrees. In this case, as shown in FIG. 11, an inner portion 56*a* of the developing roller 56 is formed of polyurethane, and the surface portion 56*b* is formed of a polyurethane elastomer having a hardness not less than Asker-C65 degrees and having a degree of polymerization higher than that of the polyurethane which constitutes the inner portion 56*a*. Such developing roller 56 is produced by preparing a cylindrical roller body formed of polyurethane, and effecting surface polymerization treatment with respect to the peripheral portion so as to provide the hardness not less than Asker-C65 degrees. Alternatively, the developing roller 56 can be provided by electrically conductive rigid and elastic roller formed of a synthetic rubber of silicone and urethane, or natural rubber having a harness not less than Asker-C65 degrees. A resistance value bridging between a central electrode 56*c* to which developing bias voltage is applied and an outer peripheral surface portion 56*b* is in a range of from about $5\times10^4$ to $1\times10^7$ Ohms.

In the developing roller 56 thus constructed, even if the developing roller 56 is brought into direct contact with the photosensitive drum 20 due to the movement of the toners for developing the electrostatic latent image onto the photosensitive drum 20 at the upper portion of the nip portion in case of solid black printing, the surface condition of the developing roller is not changed or vibrated because of high rigidity of the surface portion 56*b* of the developing roller 56. Accordingly, generation of chattering can be reduced. Therefore, it is possible to reduce the occurrence of corrugated pattern due to the chattering in the output image in spite of the fact that the toners scarcely remain at the nip portion in case of the solid black printing by enhancing the developing efficiency to about not less than 90%, that is, by providing approximately almost 100% of the developing efficiency.

Figure 12:
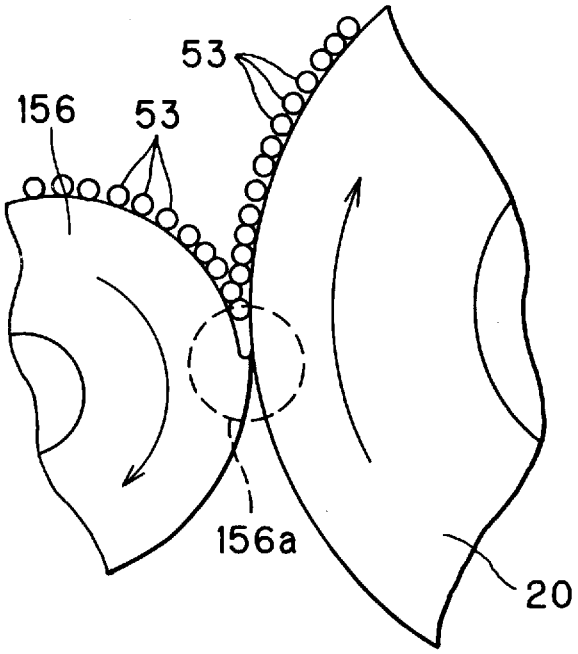
FIG. 12 is an enlarged cross-sectional view showing a developing roller and a photosensitive drum in a comparative example.

Here, as a comparative example, as shown in FIG. 12, is provided a developing roller whose surface portion is imparted with a hardness less than Asker-C65 degrees (Other conditions are the same as those of the second embodiment).

In FIG. 12, the developing roller 156 is moved in a direction opposite the moving direction of the photosensitive drum 20 at the nip portion, and further, the developing efficiency of about 100% is set. In this case, if developing operation is performed in such a manner that the toners serving as lubricants scarcely remain at the nip portion in the solid black printing, the developing roller 156 is brought into direct contact with the photosensitive drum 20. As a result, the surface of the developing roller 156 having elasticity may be changed or vibrated due to the friction at the nip portion, and as a result, chattering occurred. Due to the chattering 156*a*, corrugated pattern was generated in the output transferred image in case of the solid black printing. As is apparent from the comparative example shown in FIG. 12, the developing roller 56 according to the second embodiment is advantageous in obtaining high quality image while setting high developing efficiency. Incidentally, in FIG. 12, the chattering 156*a* and the toners 56 are exaggeratedly shown relative to the developing roller 156. However in reality, the chartings 156*a* and the toners 53 are extremely smaller than the developing roller 156.

Further, in the developing roller 56 according to the second embodiment shown in FIG. 11, the surface portion 56*b* formed of polyurethane elastomer which is subjected to polymerization treatment has improved frictional resistance and durability. Further, uniform depression of the developing roller against the surface of the photosensitive drum 20 can be obtained in the impression developing because the inner portion 56*a* is softer than the surface portion 56*b*. Consequently, high grade developing operation can be achieved.

As also described above in connection with the first embodiment with reference to FIG. 6, in order to obtain a transmission density (image density) of 2.0, the amount of toner adhering to the surface of the sheet needs to be about 0.78 mg/cm$^2$. It should be noted that when the thickness-regulating blade 57 regulates the toner amount on the developing roller 56 to 0.4 mg/cm$^2$ as described above, and provided that a development efficiency is set to about 100 percent, and peripheral velocity of the developing roller 56 is set twice as high as the peripheral velocity of the photosensitive drum 20 in case of the solid black printing, the surface portion 56*b* of the developing roller 56 is brought into direct contact with the photosensitive drum 20 without intervening the toner 53 at the nip portion. However, because the surface portion 56*b* of the developing roller 56 has a hardness not less than Asker-C65 degrees, developing operation can be performed without any chattering in contrast to the comparative example shown in FIG. 12. Incidentally, it is possible to remain small amount of toners at the surface portion 56*b* of the developing roller 56 by the Van der Waals attraction by setting the developing efficiency to slightly less than 100%. In this case, because the surface portion 56*b* of the developing roller 56 has the hardness not less than Asker -C65 degrees, occurrence of chattering can be effectively prevented in contrast to the comparative example shown in FIG. 12 even by the small amount of toners 53 which serve as lubricants.

Figure 13:
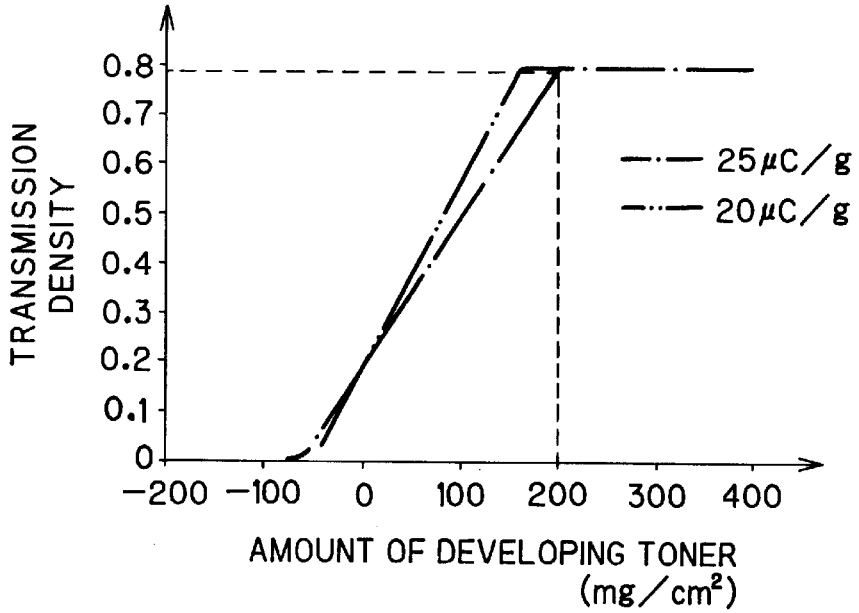
FIG. 13 is a graph showing the relationship between amount of developing toner and an effective bias voltage in the laser printer according to the second embodiment.
Figure 16:
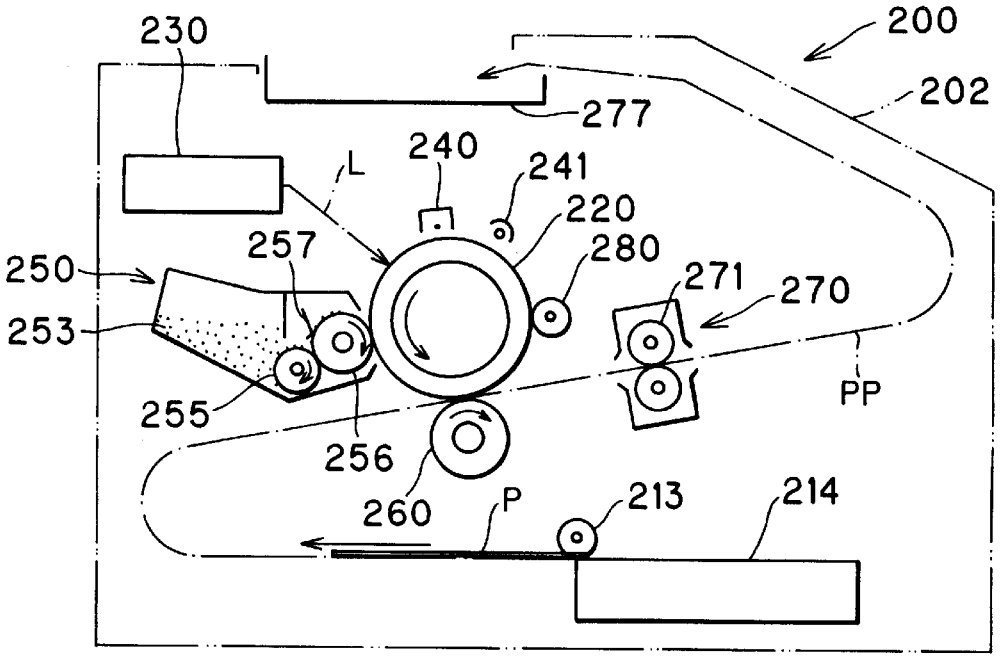
FIG. 16 PRIOR ART
FIG. 16 is a view showing a conventional laser printer of a cleaner-less type.

As an alternative, as shown in FIG. 13, in order to obtain a transmission density (image density) of 2.0, the amount of toner adhering to the surface of the sheet needs to be about 0.78 mg/cm$^2$. To this effect, the thickness-regulating blade 57 regulates the toner amount on the developing roller 56 to 0.4 mg/cm$^2$ as described above, while a development efficiency is set to slightly less than 100 percent, and peripheral velocity of the developing roller 56 is set twice as high as the peripheral velocity of the photosensitive drum 20. That is, small amount of toners 53 can remain on the developing roller 56 by the Van der Waals attraction after developing operation (by setting the developing efficiency to slightly less than 100%) in order to avoid direct contact between the surface portion 56*a* of the developing roller 56 and the photosensitive drum 20 at the nip portion without intervening toners 53. With this arrangement, generation of excessive rotational torque due to the direct contact between the developing roller 56 and the photosensitive drum 20 can be prevented, thereby protecting the surface of the developing roller 56 and avoiding insufficient printing due to the fluctuation of the rotational torque.

Because the surface portion 56*b* of the developing roller 56 is formed of polyurethane elastomer which provides excellent wear resistance and durability, the surface portion

56*b* of the developing roller is not easily worn or scratched in spite of the opposite moving directions between the developing roller and the photosensitive drum 20 at the nip portion. Furthermore, because the surface portion 56*b* of the developing roller 56 is harder than the inner portion 56*a*, the surface of the photosensitive drum 20 can be uniformly depressed in the impression developing.

As described above in the image forming device according to the second embodiment, even if almost all the toners 53 on the developing roller 56 are moved to the photosensitive drum 20 in case of the solid black printing with enhancing the developing efficiency so that the toners scarcely remain at the nip portion, in a condition where the developing roller 56 and the photosensitive drum 20 are arranged in contact with each other and the developing roller and the photosensitive member are moved in opposite directions at the contact portion, corrugated pattern in the output image can be reduced, and as a result, high quality image with high developing efficiency can be formed. That is, the deformation or vibration at the nip portion of the developing roller due to the friction can be reduced. As a result, even if the toners scarcely remain at the nip portion in case of the solid black printing by increasing the developing efficiency, i.e, at the developing efficiency close to 100%, formation of the corrugated pattern due to the chattering can be reduced in the resultant output image.

Further, the surface portion having the hardness not less than Asker-C65 degrees can easily be produced by the surface polymerization process with respect to the polyurethane. Further, the polyurethane elastomer can enhance wear resistance and durability of the surface portion. Furthermore, the developing roller can be produced at low cost if the developing roller is formed by synthetic rubber such as silicone and polyurethane. As a result, the electrophotographic type image recording device capable of providing high quality image with high developing efficiency can be provided with using the low cost developing roller.

Further, in case of a conventional developing roller formed of silicone, printing operation can be made on about 3000 sheets if the roller is installed on a low speed device, for example, a device having the impression developing system of not more than 6 p.p.m. Furthermore, in case of another conventional developing roller formed of urethane, printing operation can be made on about 5000 sheets in the same condition. On the other hand, with the developing roller according to the second embodiment, printing operation can be made on not less than ten thousand sheets. Accordingly, service life of the developing roller can be similar to or equal to service lives of ambient processing components and the photosensitive drum 20 which may be used for performing operation on several ten thousand sheets. Consequently, the developing roller 56 as well as other processing components and the photosensitive drum can be used economically, or used out simultaneously, thereby lowering running cost and promoting resource saving.

While the invention has been described in detail and with reference to the specific embodiments thereof, it would be apparent to those skilled in the art that various changes and modifications may be made therein without departing from the spirit and scope of the invention.

For example, the first drive mechanism 80 and the second drive mechanism 100 can be modified so that the rotation speed of the developing roller, etc. can be changed in accordance with the kind of the toners 53 or in accordance with the amount of the toners deposited on the developing roller 56. Alternatively, the first and second drive mechanisms 80 and 100 can be driven by an identical power source, while gear ratio thereof are properly set so as to provide speed difference between the developing roller 56 and the photosensitive drum 20.

As an alternative arrangement of the developing unit 50, a toner collection roller can be provided in the developing case 4 at a position beside the developing roller 56 and close to the laser scanner unit 30 for exclusively collecting the residual toners 53. In this case, the developing roller 56 is adapted for exclusively performing developing operation. Further, in this case, the developing unit 50 is arranged such that the residual toners 53 collected by the toner collection roller can be fed toward the toner supply roller 55 and the developing roller 56 by the rotation of the toner collection roller.

As a further alternative of the developing unit 50, the developing cycle and the toner collection cycle are performed at different timing, and biasing voltage applied to the developing roller 56 relative to the photosensitive drum 20 is changed at every cycle. For example, in the developing cycle, developing bias voltage is applied so that the positively charged toners 53 are moved (developed) from the developing roller 56 to the exposed area of the photosensitive drum 20, and in the collection cycle, collection bias voltage is applied so that the residual toners 53 are moved (collected) from the photosensitive drum 20 to the developing roller 56. In this way, according to the depicted embodiment, various arrangement can be used so as to collect residual toners in the developing unit 50 using the developing roller 56.

Further, as a material of the thickness regulation blade 57, an elastic rubber can be used instead of a metal. Further, instead of the thickness regulation blade 57, resilient spring can be urged to the developing roller 56. Alternatively, a blade which does not provide the bending portion 57*a* is also available for regulating the thickness.

Further, instead of the scorotoron type charger, a charging drum can be used which is in contact with the photosensitive drum 20.

Further, instead of the transfer roller 60, a transfer brush and non-contact type corotoron transfer unit can be used.

Further, instead of the photosensitive drum 20, a belt like photosensitive member can be used as far as the belt is moved in a direction opposite the developing roller at the nip portion.

In the above described embodiments, the photosensitive drum 20 may be formed of a positively chargeable material. However, a negatively chargeable material can also be available.

Further, the illustrated embodiment is arranged so as to collect the residual toners for recycling. For recycling the toners, a cleaning device having a cleaning blade can be provided, or toners are returned from the cleaning device to the developing unit 50 by using a toner transport spring.

Further, the illustrated embodiment pertains to the laser printer. However, the present invention can be applied to a copying machine and a facsimile machine those being an electrophotographic type image forming device using toners.

Further, the above description concerns formation of a monochromatic image. However, color image formation is also available in the above described embodiment.

What is claimed is:

1. An image forming device for forming an image on an image receiving medium comprising:

a latent image holding member having a latent image holding surface;

means for forming a latent image on the latent image holding surface;

developing means having a toner carrying member on which a toner layer is formed, the developing means providing a contact of the toner layer with the latent image holding surface forming thereon the latent image at a developing portion so as to convert the latent image into a toner image, the latent image holding member and the toner carrying member providing a nip portion at the most nearest position therebetween;

a thickness regulator positioned in confrontation with the toner carrying member, the thickness regulator regulating a thickness of the toner layer carried on the toner carrying member so that an amount of the toner carried on the toner carrying member is not more than 0.5 $mg/cm^2$;

transfer means for transferring the toner image onto the image receiving medium while the image receiving medium is moved in a direction, the toner carrying member also collecting, at a residual toner collecting portion, residual toners remaining on the latent image holding member after the transfer of the toner image onto the image receiving medium;

first drive means for driving the latent image holding member in a predetermined direction in synchronism with the movement of the image receiving medium; and second drive means for driving the toner carrying member in a direction opposite a moving direction of the latent image holding member at the nip portion.

2. The image forming device as claimed in claim 1, wherein the thickness regulator comprises a toner layer thickness regulation blade having a bending portion in direct contact with the toner carrying member and having a predetermined radius of curvature.

3. The image forming device as claimed in claim 1, wherein the toner carrying member comprises a developing roller rotatable in one rotational direction, and the latent image holding member comprises a photosensitive drum rotatable in a rotational direction the same as that of the developing roller, the developing portion being provided at an upstream of the nip portion with respect to a rotational direction of the developing roller, and the residual toner collecting portion being provided at a downstream of the nip portion with respect to the rotational direction of the developing roller.

4. The image forming device as claimed in claim 3, wherein the developing roller is formed of an elastic roller having electrical conductivity.

5. The image forming device as claimed in claim 4, wherein the second drive means provides a peripheral velocity of the developing roller not less than twice as high as a peripheral velocity of the photosensitive drum driven by the first drive means.

6. The image forming device as claimed in claim 5 wherein the transfer means is disposed above the photosensitive drum, and the latent image forming means is disposed below the photosensitive drum.

7. The image forming device as claimed in claim 6, further comprising feeding means for feeding the image receiving medium in a generally linear passage, the transfer means transferring the toner image formed on the photosensitive drum onto the image receiving medium which is fed by the feeding means.

8. The image forming device as claimed in claim 3, wherein the developing roller has a toner carrying surface portion, at least the toner carrying surface portion having a hardness not less than Asker-C 65 degrees.

9. The image forming device as claimed in claim 8, wherein the developing roller has an inner portion formed of polyurethane, and the toner carrying surface portion is formed of polyurethane elastomer, a polymerization degree of the polyurethane elastomer consisting the toner carrying surface portion being higher than a polymerization degree of the polyurethane consisting the inner portion.

10. The image forming device as claimed in claim 8, wherein the developing roller is formed of a synthetic rubber.

11. The image forming device as claimed in claim 8 wherein the transfer means is disposed above the photosensitive drum, and the latent image forming means is disposed below the photosensitive drum.

12. The image forming device as claimed in claim 11, further comprising feeding means for feeding the image receiving medium in a generally linear passage, the transfer means transferring the toner image formed on the photosensitive drum onto the image receiving medium which is fed by the feeding means.

13. The image forming device as claimed in claim 3, wherein the developing roller has a toner carrying surface portion, the surface portion being formed of polyurethane elastomer.

14. The image forming device as claimed in claim 13, wherein the developing roller has an inner portion, the inner portion having a hardness lower than that of the surface portion.

15. The image forming device as claimed in claim 3, further comprising biasing means for applying developing bias voltage to the developing roller; and wherein the developing roller comprises an inner portion and a peripheral surface portion in confrontation with the latent image holding surface, at least the surface portion being formed of an ionic conductive material.

16. The image forming device as claimed in claim 15, wherein the ionic conductive material contains urethane elastomer as a base material and liquid ammonium salt added thereto.

17. The image forming device as claimed in claim 3, further comprising a cleaning roller rotatably disposed in contact with the photosensitive drum for temporarily absorbing residual toners on the photosensitive drum and returning the absorbed toners to the photosensitive drum.

18. A developing roller device for use in an image forming device, comprising:

a developing roller body comprising an inner portion; and a surface portion provided over the inner portion and on which a toner layer is formed, at least the surface portion having a hardness not less than Asker-C 65 degrees; and a thickness regulator positioned in confrontation with the surface portion, the thickness regulator regulating a thickness of the toner layer carried on the surface portion so that an amount of the toner carried on the surface portion is not more than 0.5 $mg/cm^2$.

19. The developing roller device as claimed in claim 18, wherein the inner portion is formed of polyurethane, and the surface portion is formed of polyurethane elastomer, a polymerization degree of the polyurethane elastomer consisting the surface portion being higher than a polymerization degree of the polyurethane consisting the inner portion.

20. A developing roller device for use in an image forming device, comprising:

a developing roller body comprising an inner portion; and a surface portion provided over the inner portion and on which a toner layer is formed, at least the surface portion being formed of a polyurethane elastomer; and a thickness regulator positioned in confrontation with the surface portion, the thickness regulator regulating a thickness of the toner layer carried on the surface portion so that an amount of the toner carried on the surface portion is not more than 0.5 $mg/cm^2$.

21. The developing roller device as claimed in claim 20, wherein the inner portion has a hardness lower than that of the surface portion.

22. A developing roller device for use in an image forming devices, comprising:

a developing roller body comprising an inner portion and a peripheral surface portion formed over the inner portion and in confrontation with a photosensitive drum of the image forming device, at least the peripheral surface portion being formed of an ionic conductive material; and a thickness regulator positioned in confrontation with the peripheral surface portion, the thickness regulator regulating a thickness of a toner layer carried on the peripheral surface portion so that an amount of the toner carried on the peripheral surface portion is not more than 0.5 $mg/cm^2$.

23. The developing roller device as claimed in claim 22, wherein the ionic conductive material contains urethane elastomer as a base material and liquid ammonium salt added thereto.

* * * * *